US008868433B2

(12) United States Patent
Thesing et al.

(10) Patent No.: US 8,868,433 B2
(45) **Date of Patent: *Oct. 21, 2014**

(54) AUDIO DECODER AND DECODING METHOD USING EFFICIENT DOWNMIXING

(75) Inventors: Robin Thesing, Nürnberg (DE); James M. Silva, San Jose, CA (US); Robert L. Andersen, San Francisco, CA (US)

(73) Assignees: Dolby Laboratories Licensing Corporation, San Francisco, CA (US); Dolby International AB (SE)

( * ) Notice: Subject to any disclaimer, the term of this patent is extended or adjusted under 35 U.S.C. 154(b) by 66 days.

This patent is subject to a terminal disclaimer.

(21) Appl. No.: 13/482,878

(22) Filed: May 29, 2012

(65) Prior Publication Data

US 2012/0237039 A1 Sep. 20, 2012

Related U.S. Application Data

(63) Continuation of application No. 13/246,572, filed on Sep. 27, 2011, now Pat. No. 8,214,223, which is a continuation of application No. PCT/US2011/023533, filed on Feb. 3, 2011.

(60) Provisional application No. 61/305,871, filed on Feb. 18, 2010, provisional application No. 61/359,763, filed on Jun. 29, 2010.

(51) Int. Cl.

| | |
|---|---|
| ***G10L 19/00*** | (2013.01) |
| ***H04H 20/47*** | (2008.01) |
| ***G10L 19/008*** | (2013.01) |
| ***H04S 3/00*** | (2006.01) |

(52) U.S. Cl.

CPC ..... *G10L 19/008* (2013.01); *H04S 3/008* (2013.01)

USPC ..... 704/500; 381/2

(58) Field of Classification Search

None

See application file for complete search history.

(56) References Cited

U.S. PATENT DOCUMENTS

| | | | |
|---|---|---|---|
| 5,274,740 | A | 12/1993 | Davis et al. |
| 5,400,433 | A | 3/1995 | Davis et al. |
| 5,867,819 | A | 2/1999 | Fukuchi et al. |
| 5,946,352 | A | 8/1999 | Rowlands et al. |

(Continued)

FOREIGN PATENT DOCUMENTS

| | | |
|---|---|---|
| CN | 1757068 | 4/2006 |
| WO | WO 98/18230 | 4/1998 |
| WO | WO 98/43466 | 10/1998 |
| WO | WO 2004/059643 | 7/2004 |

OTHER PUBLICATIONS

Office Action on Columbia Patent Application No. 11 129.235 mailed Jul. 16, 2013 (including English machine-generated translation thereof).

(Continued)

*Primary Examiner* — Brian Albertalli

(74) *Attorney, Agent, or Firm* — Dov Rosenfeld; Inventek

(57) ABSTRACT

A method, an apparatus, a computer readable storage medium configured with instructions for carrying out a method, and logic encoded in one or more computer-readable tangible medium to carry out actions. The method is to decode audio data that includes N.n channels to M.m decoded audio channels, including unpacking metadata and unpacking and decoding frequency domain exponent and mantissa data; determining transform coefficients from the unpacked and decoded frequency domain exponent and mantissa data; inverse transforming the frequency domain data; and in the case M<N, downmixing according to downmixing data, the downmixing carried out efficiently.

24 Claims, 13 Drawing Sheets

```
/* TD downmix according to downmixing data*/

if (new downmixing data = old downmixing data)
{
   set up for SSE instructions;
   downmix using downmixing data;
}
else
{
   cross-fade old data to new data using a window
   downmix using cross-faded downmixing data;
}
```

1100

(56) References Cited

U.S. PATENT DOCUMENTS

| | | | |
|---|---|---|---|
| 5,986,709 | A | 11/1999 | Lee |
| 6,128,597 | A | 10/2000 | Kolluru et al. |
| 6,141,645 | A | 10/2000 | Chi-Min et al. |
| 6,205,430 | B1 | 3/2001 | Hui |
| 6,246,345 | B1 | 6/2001 | Davidson et al. |
| 6,931,291 | B1 | 8/2005 | Alvarez-Tinoco et al. |
| 7,313,519 | B2 | 12/2007 | Crockett |
| 7,318,027 | B2 | 1/2008 | Lennon et al. |
| 7,318,035 | B2 | 1/2008 | Andersen et al. |
| 7,516,064 | B2 | 4/2009 | Vinton et al. |
| 2002/0072898 | A1 | 6/2002 | Takamizawa |
| 2003/0233236 | A1 | 12/2003 | Davidson et al. |
| 2004/0122662 | A1 | 6/2004 | Crockett |
| 2007/0024472 | A1 | 2/2007 | Oh et al. |
| 2007/0027695 | A1 | 2/2007 | Oh et al. |
| 2007/0223708 | A1 | 9/2007 | Villemoes et al. |
| 2007/0233296 | A1 | 10/2007 | Kim et al. |
| 2009/0192806 | A1 | 7/2009 | Truman et al. |

OTHER PUBLICATIONS

Office Action on Taiwanese Patent Application No. 100102481 mailed Aug. 19, 2013 (including English translation thereof).

Search Report on Georgia Patent Application No. AP 2011 012462 mailed Jun. 12, 2013.

International Search Report and Written Opinion of the Intellectual Searching Authority on PCT Application PCT/US2011/023533 mailed Jul. 12, 2011.

Thakkur et al: "Internet Streaming SIMD Extensions", *Computer*, vol. 32. Issue 12, Dec. 1999.

Chen et al: "Fast time-frequency transform algorithms and their applications to real-time software implementation of AC-3 audio codec", IEEE Transactions on Consumer Electronics, vol. 44, Issue 2, May 1998, pp. 413-423.

Servetti et al: "Fast implementation of the MPEG-4 AAC main and low complexity decoder", IEEE International Conference on Acoustics, Speech, and Signal Processing, 2004; vol. 5, May 2004, pp. 249-252.

Winger: "Source adaptive software 2D IDCT with SIMD", IEEE International Conference on Acoustics, Speech, and Signal Processing, 2000; vol. 6, Jun. 2000, pp. 3642-3645.

Abel et al: "Implementation of a high-quality Dolby Digital decoder using MMXTM technology", IEEE International Conference on Acoustics, Speech, and Signal Processing, 1999; vol. 4, Mar. 1999, pp. 2371-2374.

Yoon et al: "Efficient DSP architecture for high-quality audio algorithms", IEEE International Symposium on Circuits and Systems, 2005; vol. 3, May 2005, pp. 2947-2950.

Yoon et al: "Design of a high-quality audio-specific DSP core", IEEE Workshop on Signal Processing Systems Design and Implementation, 2005; Nov. 2005, pp. 509-513.

Ryu et al: "Audio-Specific Signal Processor(ASSP) for High-Quality Audio Codec", Asian Solid-State Circuits Conference, 2005; Nov. 2005, pp. 429-432.

Poondikulam et al: "Efficient Implementation of Transform Based Audio Coders using SIMD Paradigm and Multifunction Computations", Sasken Communications Technologies Limited, Bangalore, India, Available Jul. 31, 2009 at www.mp3-tech.org/programmer/docs/paper_0007.pdf.

Domazet et al: "Advanced Software Implementation of MPEG-4 AAC Audio Encoder", 4th EURASIP Conference focused on Video/Image Processing and Multimedia Communications, Jul. 2-5, 2003, pp. 679-684.

Smithers et al: "Increased efficiency MPEG-2 AAC Encoding", Audio Engineering Society Convention Paper 5490, AES 111$^{th}$ Convention, Sep. 2001.

"Liba52—a free ATSC A/52 stream decoder", downloaded Aug. 18, 2009 from http://liba52.sourceforge.net/.

ATSC: "Digital audio compression standard (AC-3, E-AC-3), revision B", Document A/52B, ATSC standard, Jun. 14, 2005.

Fielder et al: "Introduction to Dolby Digital Plus, an Enhancement to the Dolby Digital Coding System", AES Convention 117, Audio Engineering Society Convention Paper 6196, Oct. 2004.

Dolby Laboratories: "Downmixing Before Inverse Transform", a "Frequently Asked Questions" (FAQ) document distributed with Dolby Digital Decoder Implementation Development Kit v2.0 by Dolby Laboratories, Inc., San Francisco, CA, released 1999.

Cavigioli et al: "Optimizing the Implementation of Dolby Digital Plus in SoC Designs", Dolby Laboratories, Inc., San Francisco, CA, White Paper, Jan. 2007, retrieved on Nov. 18, 2011 from http://www.dolby.com/uploadedFiles/English_%28US%29/Professional/Technical_Library/Technologies/Dolby_Digital_Plus/co_tp_0701_MIPS_DDPlus.pdf.

Dressler et al: "Dolby Audio Coding for Future Entertainment Formats", Dolby Laboratories, Inc., San Francisco, CA, White Paper, 2006, retrieved on Nov. 18, 2011 from http://www.dolby.com/uploadedFiles/zz-_Shared_Assets/English_PDFs/Professional/DPlus_TrueHD_whitepaper.pdf.

Extended European Search Report for EPO Application No. 11154910.1 mailed Jul. 13, 2011.

Office Action on China Patent Application No. 201180002121.4 mailed Nov. 5, 2012 (English translation thereof).

Search Report and Preliminary Examination Report on European Application No. 13189503.9 mailed Mar. 27, 2014.

James C Abel et al: "MMX-Enabled Dolby Digital Decoder—Improving Execution Time", IEEE Signal Processing Magazine, vol. 17, No. 2, pp. 36-42, Mar. 1, 2000.

```
Unpack BSI data
For block = 1 to B (the number of blocks)
    Unpack fixed data
    Save pointers to packed exponents
    For chan = 1 to N (the number of coded channels)
        Unpack exponents
        For band = 1 to L (the number of bands)
            Compute bit allocation
            Unpack mantissas
            Unpack coupling channel (save ptrs)
            Scale mantissas / undo coupling
            Denormalize mantissas by exponents
        Compute inverse transform to window domain
        Downmix to appropriate number M of output channel(s)
    For chan = 1 to M (the number of output channels)
        Window & overlap-add with a delay buffer
        Copy downmix buffer values to delay buffer
```

100

FIG. 1
(Prior Art)

Front-end decode 300

```
/* First pass front-end decode */
For block = 0 to B-1 (B=number of blocks)
{
   Unpack fixed data
   For chan = 0 to N-1 (N=number of coded channels)
   {
      Save bitstream pointer to packed exponents
      Unpack exponents
      Save bitstream pointer to packed mantissas
      Compute bit allocation
      Skip Mantissas based on bit allocation
   }
}

/* Second pass front-end decode */
For channel = 0 to N-1 (N=number of coded channels)
{
   For block = 0 to B-1 (B=number of blocks)
   {
      /* unpack */
      Load saved bitstream pointer to packed exponents
      Unpack exponents
      Compute bit allocation
      Load saved bitstream pointer to packed mantissas
      Unpack mantissas
      /* decode */
      Perform standard/enhanced (amplitude-only) decoupling
      Generate spectral extension band
   }
   Transfer exponent and mantissa data from internal to external memory
}
```

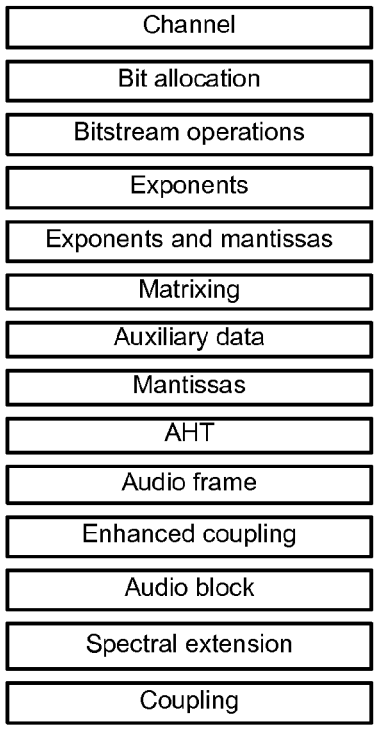

FIG. 3

500

Back-end decode:

```
For block = 0 to B-1 (B=blocks per frame)
{
  Transfer in all blocks of a channel from external memory
  For channel = 0 to N-1 and LFE if n=1 (N.n= number of coded channels)
   {
     Apply dynamic range control, dialog normalization, and gain ranging
     Denormalize mantissas by exponents
     Compute inverse transform
     Window / overlap-add with delay buffer
     Perform transient pre-noise processing
     Downmix to apprpriate output channel(s)
     }
}
```

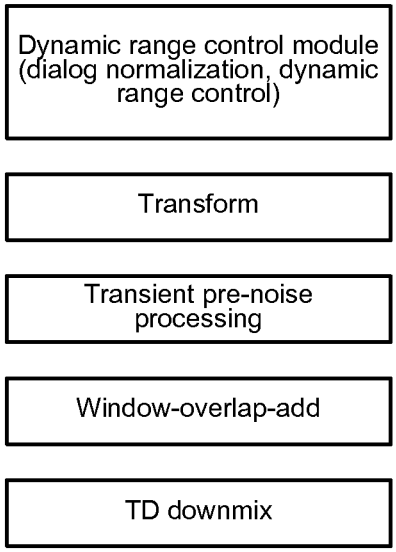

FIG. 5A

520

```
% Back-end decode:

For block = 0 to B-1 (B=blocks per frame)
{
  Transfer in all blocks of a channel from external memory
  Ascertain if FD downmixing or TD downmixing
  If FD downmixing:
   {

     For channel = 0 to N-1 and LFE if n=1
       {
        Apply dynamic range control, dialog normalization, but disable gain ranging
        Denormalize mantissas by exponents
        FD downmix
        Process differently transition block following TD downmixed block
        Deal with any fading out channels
       }
   }
  Else % TD downmixing
   {
     For channel = 0 to N-1 and LFE if n=1  (BUT only for channels in downmix)
      {
        Process differently transition block following FD downmixed block
        Apply dynamic range control, dialog normalization, but disable gain ranging
        Denormalize mantissas by exponents
      }
   }
  For channel = 0 to N-1 and LFE if n=1  (BUT only for channels in downmix; N=M if FD
                                          downmix)
   {
     Compute inverse transform
     Window / overlap-add with delay buffer
     If TD downmix
       {
        Perform transient pre-noise processing
        Downmix to appropriate output channel(s)
       }
   }
}
```

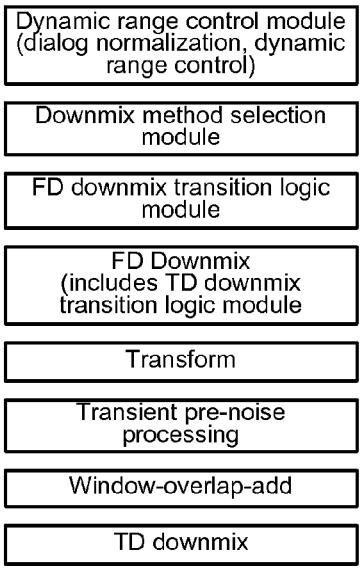

FIG. 5B

```
/* TD downmix according to downmixing data*/

if (new downmixing data = old downmixing data)
{
    set up for SSE instructions;
    downmix using downmixing data;
}
else
{
   cross-fade old data to new data using a window
   downmix using cross-faded downmixing data;
}
```

1100

FIG. 11

AUDIO DECODER AND DECODING METHOD USING EFFICIENT DOWNMIXING

CROSS-REFERENCE TO RELATED APPLICATIONS

This application is a continuation under 35 U.S.C. 111(a) of U.S. patent application Ser. No. 13/246,572 filed 27 Sep. 2011, now U.S. Pat. No. 8,214,223, the contents of which are hereby incorporated herein by reference. U.S. patent application Ser. No. 13/246,572 is a continuation under 35 U.S.C. 111(a) of International Application No. PCT/US2011/023533 having International Filing Date of 3 Feb. 2011 and titled AUDIO DECODER AND DECODING METHOD USING EFFICIENT DOWNMIXING. International Application No. PCT/US2011/023533 claims priority to U.S. Provisional Patent Application Nos. 61/305,871, filed 18 Feb. 2010 and 61/359,763, filed 29 Jun. 2010. The contents of International Application PCT/US2011/023533, and U.S. Application 61/305,871 and 61/359,763 are hereby incorporated by reference.

FIELD OF THE INVENTION

The present disclosure relates generally to audio signal processing.

BACKGROUND

Digital audio data compression has become an important technique in the audio industry. New formats have been introduced that allow high quality audio reproduction without the need for the high data bandwidth that would be required using traditional techniques. AC-3 and more recently Enhanced AC-3 (E-AC-3) coding technology has been adopted by the Advanced Television Systems Committee (ATSC) as the audio service standard for High Definition Television (HDTV) in the United States. E-AC-3 has also found applications in consumer media (digital video disc) and direct satellite broadcast. E-AC-3 is an example of perceptual coding, and provides for coding multiple channels of digital audio to a bitstream of coded audio and metadata.

There is interest in efficiently decoding a coded audio bit stream. For example, the battery life of portable devices is mainly limited by the energy consumption of its main processing unit. The energy consumption of a processing unit is closely related to the computational complexity of its tasks. Hence, reducing the average computational complexity of a portable audio processing system should extend the battery life of such a system.

The term x86 is commonly understood by those having skill in the art to refer to a family of processor instruction set architectures whose origins trace back to the Intel 8086 processor. As result of the ubiquity of the x86 instructions set architecture, there also is interest in efficiently decoding a coded audio bit stream on a processor or processing system that has an x86 instruction set architecture. Many decoder implementations are general in nature, while others are specifically designed for embedded processors. New processors, such as AMD's Geode and the new Intel Atom are examples of 32-bit and 64-bit designs that use the x86 instruction set and that are being used in small portable devices.

BRIEF DESCRIPTION OF THE DRAWINGS

FIG. 1 shows pseudocode 100 for instructions that, when executed, carry out a typical AC-3 decoding process.

FIG. 3 shows a pseudocode and a simplified block diagram of one embodiment of a front-end decode module.

FIG. 5A shows pseudocode and a simplified block diagram of one embodiment of a back-end decode module.

FIG. 5B shows pseudocode and a simplified block diagram of another embodiment of a back-end decode module.

FIG. 11 shows a simplified pseudocode for one embodiment of time domain downmixing.

DESCRIPTION OF EXAMPLE EMBODIMENTS

Overview

Figure 2A:
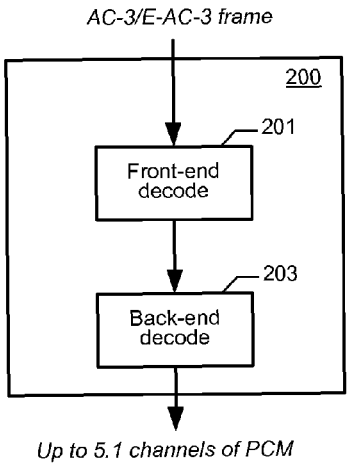
FIGS. 2A-2D show, in simplified block diagram form, some different decoder configurations that can advantageously use one or more common modules.

Embodiments of the present invention include a method, an apparatus, and logic encoded in one or more computer-readable tangible medium to carry out actions.

Particular embodiments include a method of operating an audio decoder to decode audio data that includes encoded blocks of N.n channels of audio data to form decoded audio data that includes M.m channels of decoded audio, $M \geq 1$, n being the number of low frequency effects channels in the encoded audio data, and m being the number of low frequency effects channels in the decoded audio data. The method comprises accepting the audio data that includes blocks of N.n channels of encoded audio data encoded by an encoding method that includes transforming N.n channels of digital audio data, and forming and packing frequency domain exponent and mantissa data; and decoding the accepted audio data. The decoding includes: unpacking and decoding the frequency domain exponent and mantissa data; determining transform coefficients from the unpacked and decoded frequency domain exponent and mantissa data; inverse transforming the frequency domain data and applying further processing to determine sampled audio data; and time domain downmixing at least some blocks of the determined sampled audio data according to downmixing data for the case $M<N$. At least one of A1, B1, and C1 is true:

A1 being that the decoding includes determining block by block whether to apply frequency domain downmixing or time domain downmixing, and if it is determined for a particular block to apply frequency domain downmixing, applying frequency domain downmixing for the particular block, B1 being that the time domain downmixing includes testing whether the downmixing data are changed from previously used downmixing data, and, if changed, applying cross-fading to determine cross-faded downmixing data and time domain downmixing according to the cross-faded downmixing data, and if unchanged, directly time domain downmixing according to the downmixing data, and C1 being that the method includes identifying one or more non-contributing channels of the N.n input channels, a non-contributing channel being a channel that does not contribute to the M.m channels, and that the method does not carry out inverse transforming the frequency domain data and the applying further processing on the identified one or more non-contributing channels.

Particular embodiments of the invention include a computer-readable storage medium storing decoding instructions that when executed by one or more processors of a processing system cause the processing system to carry out decoding audio data that includes encoded blocks of N.n channels of audio data to form decoded audio data that includes M.m channels of decoded audio, M≥1, n being the number of low frequency effects channels in the encoded audio data, and m being the number of low frequency effects channels in the decoded audio data. The decoding instructions include: instructions that when executed cause accepting the audio data that includes blocks of N.n channels of encoded audio data encoded by an encoding method, the encoding method including transforming N.n channels of digital audio data, and forming and packing frequency domain exponent and mantissa data; and instructions that when executed cause decoding the accepted audio data. The instructions that when executed cause decoding include: instructions that when executed cause unpacking and decoding the frequency domain exponent and mantissa data; instructions that when executed cause determining transform coefficients from the unpacked and decoded frequency domain exponent and mantissa data; instructions that when executed cause inverse transforming the frequency domain data and applying further processing to determine sampled audio data; and instructions that when executed cause ascertaining if M<N and instructions that when executed cause time domain downmixing at least some blocks of the determined sampled audio data according to downmixing data if M<N. At least one of A2, B2, and C2 is true:

A2 being that the instructions that when executed cause decoding include instructions that when executed cause determining block by block whether to apply frequency domain downmixing or time domain downmixing, and instructions that when executed cause applying frequency domain downmixing if it is determined for a particular block to apply frequency domain downmixing, B2 being that the time domain downmixing includes testing whether the downmixing data are changed from previously used downmixing data, and, if changed, applying cross-fading to determine cross-faded downmixing data and time domain downmixing according to the cross-faded downmixing data, and if unchanged, directly time domain downmixing according to the downmixing data, and C2 being that the instructions that when executed cause decoding include identifying one or more non-contributing channels of the N.n input channels, a non-contributing channel being a channel that does not contribute to the M.m channels, and that the method does not carry out inverse transforming the frequency domain data and the applying further processing on the one or more identified non-contributing channels.

Particular embodiments include an apparatus for processing audio data to decode the audio data that includes encoded blocks of N.n channels of audio data to form decoded audio data that includes M.m channels of decoded audio, M≥1, n being the number of low frequency effects channels in the encoded audio data, and m being the number of low frequency effects channels in the decoded audio data. The apparatus comprises: means for accepting the audio data that includes blocks of N.n channels of encoded audio data encoded by an encoding method, the encoding method including transforming N.n channels of digital audio data, and forming and packing frequency domain exponent and mantissa data; and means for decoding the accepted audio data. The means for decoding includes: means for unpacking and decoding the frequency domain exponent and mantissa data; means for determining transform coefficients from the unpacked and decoded frequency domain exponent and mantissa data; means for inverse transforming the frequency domain data and for applying further processing to determine sampled audio data; and means for time domain downmixing at least some blocks of the determined sampled audio data according to downmixing data for the case M<N. At least one of A3, B3, and C3 is true:

A3 being that the means for decoding includes means for determining block by block whether to apply frequency domain downmixing or time domain downmixing, and means for applying frequency domain downmixing, the means for applying frequency domain downmixing applying frequency domain downmixing for the particular block if it is determined for a particular block to apply frequency domain downmixing, B3 being that the means for time domain downmixing carries out testing whether the downmixing data are changed from previously used downmixing data, and, if changed, applies cross-fading to determine cross-faded downmixing data and time domain downmixing according to the cross-faded downmixing data, and if unchanged, directly applies time domain downmixing according to the downmixing data, and C3 being that the apparatus includes means for identifying one or more non-contributing channels of the N.n input channels, a non-contributing channel being a channel that does not contribute to the M.m channels, and that the apparatus does not carry out inverse transforming the frequency domain data and the applying further processing on the one or more identified non-contributing channels.

Particular embodiments include an apparatus for processing audio data that includes N.n channels of encoded audio data to form decoded audio data that includes M.m channels of decoded audio, M≥1, n=0 or 1 being the number of low frequency effects channels in the encoded audio data, and m=0 or 1 being the number of low frequency effects channels in the decoded audio data. The apparatus comprises: means for accepting the audio data that includes N.n channels of encoded audio data encoded by an encoding method, the encoding method comprising transforming N.n channels of digital audio data in a manner such that inverse transforming and further processing can recover time domain samples without aliasing errors, forming and packing frequency domain exponent and mantissa data, and forming and packing metadata related to the frequency domain exponent and mantissa data, the metadata optionally including metadata related to transient pre-noise processing; and means for decoding the accepted audio data. The means for decoding comprises: one or more means for front-end decoding and one or more means for back-end decoding. The means for front-end decoding includes means for unpacking the metadata, for unpacking and for decoding the frequency domain exponent and mantissa data. The means for back-end decoding includes means for determining transform coefficients from the unpacked and decoded frequency domain exponent and mantissa data; for inverse transforming the frequency domain data; for applying windowing and overlap-add operations to determine sampled audio data; for applying any required transient pre-noise processing decoding according to the metadata related to transient pre-noise processing; and for time domain downmixing according to downmixing data, the downmixing configured to time domain downmix at least some blocks of data according to downmixing data in the case M<N. At least one of A4, B4, and 4C is true:

A4 being that the means for back end decoding include means for determining block by block whether to apply frequency domain downmixing or time domain downmixing, and means for applying frequency domain downmixing, the means for applying frequency domain downmixing applying frequency domain downmixing for the particular block if it is determined for a particular block to apply frequency domain downmixing, B4 being that the means for time domain downmixing carries out testing whether the downmixing data are changed from previously used downmixing data, and, if changed, applies cross-fading to determine cross-faded downmixing data and time domain downmixing according to the cross-faded downmixing data, and if unchanged, directly applies time domain downmixing according to the downmixing data, and C4 being that the apparatus includes means for identifying one or more non-contributing channels of the N.n input channels, a non-contributing channel being a channel that does not contribute to the M.m channels, and that the means for back end decoding does not carry out inverse transforming the frequency domain data and the applying further processing on the one or more identified non-contributing channels.

Particular embodiments include a system to decode audio data that includes N.n channels of encoded audio data to form decoded audio data that includes M.m channels of decoded audio, M≥1, n being the number of low frequency effects channels in the encoded audio data, and m being the number of low frequency effects channels in the decoded audio data. The system comprises: one or more processors; and a storage subsystem coupled to the one or more processors. The system is to accept the audio data that includes blocks of N.n channels of encoded audio data encoded by an encoding method, the encoding method including transforming N.n channels of digital audio data, and forming and packing frequency domain exponent and mantissa data; and further to decode the accepted audio data, including to: unpack and decode the frequency domain exponent and mantissa data; determine transform coefficients from the unpacked and decoded frequency domain exponent and mantissa data; inverse transform the frequency domain data and apply further processing to determine sampled audio data; and time domain downmix at least some blocks of the determined sampled audio data according to downmixing data for the case M<N. At least one of A5, B5, and C5 is true:

A5 being that the decoding includes determining block by block whether to apply frequency domain downmixing or time domain downmixing, and if it is determined for a particular block to apply frequency domain downmixing, applying frequency domain downmixing for the particular block, B5 being that the time domain downmixing includes testing whether the downmixing data are changed from previously used downmixing data, and, if changed, applying cross-fading to determine cross-faded downmixing data and time domain downmixing according to the cross-faded downmixing data, and if unchanged, directly time domain downmixing according to the downmixing data, and C5 being that the method includes identifying one or more non-contributing channels of the N.n input channels, a non-contributing channel being a channel that does not contribute to the M.m channels, and that the method does not carry out inverse transforming the frequency domain data and the applying further processing on the one or more identified non-contributing channels.

In some versions of the system embodiment, the accepted audio data are in the form of a bitstream of frames of coded data, and the storage subsystem is configured with instructions that when executed by one or more of the processors of the processing system, cause decoding the accepted audio data.

Some versions of the system embodiment include one or more subsystems that are networked via a network link, each subsystem including at least one processor.

In some embodiments in which A1, A2, A3, A4 or A5 is true, the determining whether to apply frequency domain downmixing or time domain downmixing includes determining if there is any transient pre-noise processing, and determining if any of the N channels have a different block type such that frequency domain downmixing is applied only for a block that has the same block type in the N channels, no transient pre-noise processing, and M<N.

In some embodiments in which A1, A2, A3, A4 or A5 is true, and wherein the transforming in the encoding method uses an overlapped-transform and the further processing includes applying windowing and overlap-add operations to determine sampled audio data, (i) applying frequency domain downmixing for the particular block includes determining if downmixing for the previous block was by time domain downmixing and, if the downmixing for the previous block was by time domain downmixing, applying time domain downmixing (or downmixing in a pseudo-time domain) to the data of the previous block that is to be overlapped with the decoded data of the particular block, and (ii) applying time domain downmixing for a particular block includes determining if downmixing for the previous block was by frequency domain downmixing, and if the downmixing for the previous block was by frequency domain downmixing, processing the particular block differently than if the downmixing for the previous block was not by frequency domain downmixing.

In some embodiments in which B1, B2, B3, B4 or B5 is true, at least one x86 processor is used whose instruction set includes streaming single instruction multiple data extensions (SSE) comprising vector instructions, and the time domain downmixing includes running vector instructions on at least one of the one or more x86 processors.

In some embodiments in which C1, C2, C3, C4 or C5 is true, n=1 and m=0, such that inverse transforming and applying further processing are not carried out on the low frequency effect channel. Furthermore, in some embodiments in which C is true, the audio data that includes encoded blocks includes information that defines the downmixing, and wherein the identifying one or more non-contributing channels uses the information that defines the downmixing. Furthermore, in some embodiments in which C is true, the identifying one or more non-contributing channels further includes identifying whether one or more channels have an insignificant amount of content relative to one or more other channels, wherein a channel has an insignificant amount of content relative to another channel if its energy or absolute level is at least 15 dB below that of the other channel. For some cases, a channel has an insignificant amount of content relative to another channel if its energy or absolute level is at least 18 dB below that of the other channel, while for other applications, a channel has an insignificant amount of content relative to another channel if its energy or absolute level is at least 25 dB below that of the other channel.

In some embodiments the encoded audio data are encoded according to one of the set of standards consisting of the AC-3 standard, the E-AC-3 standard, a standard backwards compatible with the E-AC-3 standard, the MPEG-2 AAC standard, and the HE-AAC standard.

In some embodiments of the invention, the transforming in the encoding method uses an overlapped-transform, and the further processing includes applying windowing and overlap-add operations to determine sampled audio data.

In some embodiments of the invention, the encoding method includes forming and packing metadata related to the frequency domain exponent and mantissa data, the metadata optionally including metadata related to transient pre-noise processing and to downmixing.

Particular embodiments may provide all, some, or none of these aspects, features, or advantages. Particular embodiments may provide one or more other aspects, features, or advantages, one or more of which may be readily apparent to a person skilled in the art from the figures, descriptions, and claims herein.

Decoding an Encoded Stream

Embodiments of the present invention are described for decoding audio that has been coded according to the Extended AC-3 (E-AC-3) standard to a coded bitstream. The E-AC-3 and the earlier AC-3 standards are described in detail in Advanced Television Systems Committee, Inc., (ATSC), "Digital Audio Compression Standard (AC-3, E-AC-3)," Revision B, Document A/52B, 14 Jun. 2005, retrieved 1 Dec. 2009 on the World Wide Web of the Internet at www^dot^atsc-^dot^org/standards/a_52b^dot^pdf, (where ^dot^ denoted the period ("·") in the actual Web address). The invention, however, is not limited to decoding a bitstream encoded in E-AC-3, and may be applied to a decoder and for decoding a bitstream encoded according to another coding method, and to methods of such decoding, apparatuses to decode, systems that carry out such decoding, to software that when executed cause one or more processors to carry out such decoding, and/or to tangible storage media on which such software is stored. For example, embodiments of the present invention are also applicable to decoding audio that has been coded according to the MPEG-2 AAC (ISO/IEC 13818-7) and MPEG-4 Audio (ISO/IEC 14496-3) standards. The MPEG-4 Audio standard includes both High Efficiency AAC version 1 (HE-AAC v1) and High Efficiency AAC version 2 (HE-AAC v2) coding, referred to collectively as HE-AAC herein.

AC-3 and E-AC-3 are also known as DOLBY® DIGITAL and DOLBY® DIGITAL PLUS. A version of HE-AAC incorporating some additional, compatible improvements is also known as DOLBY® PULSE. These are trademarks of Dolby Laboratories Licensing Corporation, the assignee of the present invention, and may be registered in one or more jurisdictions. E-AC-3 is compatible with AC-3 and includes additional functionality.

The x86 Architecture

The term x86 is commonly understood by those having skill in the art to refer to a family of processor instruction set architectures whose origins trace back to the Intel 8086 processor. The architecture has been implemented in processors from companies such as Intel, Cyrix, AMD, VIA, and many others. In general, the term is understood to imply a binary compatibility with the 32-bit instruction set of the Intel 80386 processor. Today (early 2010), the x86 architecture is ubiquitous among desktop and notebook computers, as well as a growing majority among servers and workstations. A large amount of software supports the platform, including operating systems such as MS-DOS, Windows, Linux, BSD, Solaris, and Mac OS X.

As used herein, the term x86 means an x86 processor instruction set architecture that also supports a single instruction multiple data (SIMD) instruction set extension (SSE). SSE is a single instruction multiple data (SIMD) instruction set extension to the original x86 architecture introduced in 1999 in Intel's Pentium III series processors, and now common in x86 architectures made by many vendors.

AC-3 and E-AC-3 bitstreams

An AC-3 bitstream of a multi-channel audio signal is composed of frames, representing a constant time interval of 1536 pulse code modulated (PCM) samples of the audio signal across all coded channels. Up to five main channels and optionally a low frequency effects (LFE) channel denoted "0.1" are provided for, that is, up to 5.1 channels of audio are provided for. Each frame has a fixed size, which depends only on sample rate and coded data rate.

Briefly, AC-3 coding includes using an overlapped transform—the modified discrete cosine transform (MDCT) with a Kaiser Bessel derived (KBD) window with 50% overlap—to convert time data to frequency data. The frequency data are perceptually coded to compress the data to form a compressed bitstream of frames that each includes coded audio data and metadata. Each AC-3 frame is an independent entity, sharing no data with previous frames other than the transform overlap inherent in the MDCT used to convert time data to frequency data.

At the beginning of each AC-3 frame are the SI (Sync Information) and BSI (Bit Stream Information) fields. The SI and BSI fields describe the bitstream configuration, including sample rate, data rate, number of coded channels, and several other systems-level elements. There are also two CRC (cyclic redundancy code) words per frame, one at the beginning and one at the end, that provide a means of error detection.

Within each frame are six audio blocks, each representing 256 PCM samples per coded channel of audio data. The audio block contains the block switch flags, coupling coordinates, exponents, bit allocation parameters, and mantissas. Data sharing is allowed within a frame, such that information present in Block 0 may be reused in subsequent blocks.

An optional aux data field is located at the end of the frame. This field allows system designers to embed private control or status information into the AC-3 bitstream for system-wide transmission.

E-AC-3 preserves the AC-3 frame structure of six 256-coefficient transforms, while also allowing for shorter frames composed of one, two, and three 256-coefficient transform blocks. This enables the transport of audio at data rates greater than 640 kbps. Each E-AC-3 frame includes metadata and audio data.

E-AC-3 allows for a significantly larger number of channels than AC-3's 5.1, in particular, E-AC-3 allows for the carriage of 6.1 and 7.1 audio common today, and for the carriage of at least 13.1 channels to support, for example, future multichannel audio sound tracks. The additional channels beyond 5.1 are obtained by associating the main audio program bitstream with up to eight additional dependent substreams, all of which are multiplexed into one E-AC-3 bitstream. This allows the main audio program to convey the 5.1-channel format of AC-3, while the additional channel capacity comes from the dependent bitstreams. This means that a 5.1-channel version and the various conventional downmixes are always available and that matrix subtraction-induced coding artifacts are eliminated by the use of a channel substitution process.

Multiple program support is also available through the ability to carry seven more independent audio streams, each with possible associated dependent substreams, to increase the channel carriage of each program beyond 5.1 channels.

AC-3 uses a relatively short transform and simple scalar quantization to perceptually code audio material. E-AC-3, while compatible with AC-3, provides improved spectral resolution, improved quantization, and improved coding. With E-AC-3, coding efficiency has been increased from that of AC-3 to allow for the beneficial use of lower data rates. This is accomplished using an improved filterbank to convert time data to frequency domain data, improved quantization, enhanced channel coupling, spectral extension, and a technique called transient pre-noise processing (TPNP).

In addition to the overlapped transform MDCT to convert time data to frequency data, E-AC-3 uses an adaptive hybrid transform (AHT) for stationary audio signals. The AHT includes the MDCT with the overlapping Kaiser Bessel derived (KBD) window, followed, for stationary signals, by a secondary block transform in the form of a non-windowed, non-overlapped Type II discrete cosine transform (DCT). The AHT thus adds a second stage DCT after the existing AC-3 MDCT/KBD filterbank when audio with stationary characteristics is present to convert the six 256-coefficient transform blocks into a single 1536-coefficient hybrid transform block with increased frequency resolution. This increased frequency resolution is combined with 6-dimensional vector quantization (VQ) and gain adaptive quantization (GAQ) to improve the coding efficiency for some signals, e.g., "hard to code" signals. VQ is used to efficiently code frequency bands requiring lower accuracies, while GAQ provides greater efficiency when higher accuracy quantization is required.

Improved coding efficiency is also obtained through the use of channel coupling with phase preservation. This method expands on AC-3's channel coupling method of using a high frequency mono composite channel which reconstitutes the high-frequency portion of each channel on decoding. The addition of phase information and encoder-controlled processing of spectral amplitude information sent in the bitstream improves the fidelity of this process so that the mono composite channel can be extended to lower frequencies than was previously possible. This decreases the effective bandwidth encoded, and thus increases the coding efficiency.

E-AC-3 also includes spectral extension. Spectral extension includes replacing upper frequency transform coefficients with lower frequency spectral segments translated up in frequency. The spectral characteristics of the translated segments are matched to the original through spectral modulation of the transform coefficients, and also through blending of shaped noise components with the translated lower frequency spectral segments.

E-AC-3 includes a low frequency effects (LFE) channel. This is an optional single channel of limited (<120 Hz) bandwidth, which is intended to be reproduced at a level +10 dB with respect to the full bandwidth channels. The optional LFE channel allows high sound pressure levels to be provided for low frequency sounds. Other coding standards, e.g., AC-3 and HE-AAC also include an optional LFE channel.

An additional technique to improve audio quality at low data rates is the use of transient pre-noise processing, described further below.

AC-3 Decoding

In typical AC-3 decoder implementations, in order to keep memory and decoder latency requirements as small as possible, each AC-3 frame is decoded in a series of nested loops.

A first step establishes frame alignment. This involves finding the AC-3 synchronization word, and then confirming that the CRC error detection words indicate no errors. Once frame synchronization is found, the BSI data are unpacked to determine important frame information such as the number of coded channels. One of the channels may be an LFE channel. The number of coded channels is denoted N.n herein, where n is the number of LFE channels, and N is the number of main channels. In currently used coding standards, n=0 or 1. In the future, there may be cases where n>1

The next step in decoding is to unpack each of the six audio blocks. In order to minimize the memory requirements of the output pulse code modulated data (PCM) buffers, the audio blocks are unpacked one-at-a-time. At the end of each block period the PCM results are, in many implementations, copied to output buffers, which for real-time operation in a hardware decoder typically are double- or circularly buffered for direct interrupt access by a digital-to-analog converter (DAC).

The AC-3 decoder audio block processing may be divided into two distinct stages, referred to here as input and output processing. Input processing includes all bitstream unpacking and coded channel manipulation. Output processing refers primarily to the windowing and overlap-add stages of the inverse MDCT transform.

This distinction is made because the number of main output channels, herein denoted M≥1, generated by an AC-3 decoder does not necessarily match the number of input main channels, herein denoted N, N≥1 encoded in the bitstream, with typically, but not necessarily, N≥M. By use of downmixing, a decoder can accept a bitstream with any number N of coded channels and produce an arbitrary number M, M≥1, of output channels. Note that in general, the number of output channels is denoted M.m herein, where M is the number of main channels, and m is the number of LFE output channels. In today's applications, m=0 or 1. It may be possible to have m>1 in the future.

Note that in the downmixing, not all of the coded channels are included in the output channels. For example, in a 5.1 to stereo downmix, the LFE channel information is usually discarded. Thus, in some downmixing, n=1 and m=0, that is, there is no output LFE channel.

FIG. 1 shows pseudocode 100 for instructions, that when executed, carry out a typical AC-3 decoding process.

Input processing in AC-3 decoding typically begins when the decoder unpacks the fixed audio block data, which is a collection of parameters and flags located at the beginning of the audio block. This fixed data includes such items as block switch flags, coupling information, exponents, and bit allocation parameters. The term "fixed data" refers to the fact that the word sizes for these bitstream elements are known a priori, and therefore a variable length decoding process is not required to recover such elements.

The exponents make up the single largest field in the fixed data region, as they include all exponents from each coded channel. Depending on the coding mode, in AC-3, there may be as many as one exponent per mantissa, up to 253 mantissas per channel. Rather than unpack all of these exponents to local memory, many decoder implementations save pointers to the exponent fields, and unpack them as they are needed, one channel at a time.

Once the fixed data are unpacked, many known AC-3 decoders begin processing each coded channel. First, the exponents for the given channel are unpacked from the input frame. A bit allocation calculation is then typically performed, which takes the exponents and bit allocation parameters and computes the word sizes for each packed mantissa. The mantissas are then typically unpacked from the input frame. The mantissas are scaled to provide appropriate dynamic range control, and if needed, to undo coupling operation, and then denormalized by the exponents. Finally, an inverse transform is computed to determine pre-overlap-add data, data in what is called the "window domain," and the results are downmixed into the appropriate downmix buffers for subsequent output processing.

In some implementations, the exponents for the individual channel are unpacked into a 256-sample long buffer, called the "MDCT buffer." These exponents are then grouped into as many as 50 bands for bit allocation purposes. The number of exponents in each band increases toward higher audio frequencies, roughly following a logarithmic division that models psychoacoustic critical bands.

For each of these bit allocation bands, the exponents and bit allocation parameters are combined to generate a mantissa word size for each mantissa in that band. These word sizes are stored in a 24-sample long band buffer, with the widest bit allocation band made up of 24 frequency bins. Once the word sizes have been computed, the corresponding mantissas are unpacked from the input frame and stored in-place back into the band buffer. These mantissas are scaled and denormalized by the corresponding exponent, and written, e.g., written in-place back into the MDCT buffer. After all bands have been processed, and all mantissas unpacked, any remaining locations in the MDCT buffer are typically written with zeros.

An inverse transform is performed, e.g., performed in-place in the MDCT buffer. The output of this processing, the window domain data, can then be downmixed into the appropriate downmix buffers according to downmix parameters, determined according to metadata, e.g., fetched from predefined data according to metadata.

Once the input processing is completed and the downmix buffers have been fully generated with window domain downmixed data, the decoder can perform the output processing. For each output channel, a downmix buffer and its corresponding 128-sample long half-block delay buffer are windowed and combined to produce 256 PCM output samples. In a hardware sound system that includes a decoder and one or more DACs, these samples are rounded to the DAC word width and copied to the output buffer. Once this is done, half of the downmix buffer is then copied to its corresponding delay buffer, providing the 50% overlap information necessary for proper reconstruction of the next audio block.

E-AC-3 Decoding

Particular embodiments of the present invention include a method of operating an audio decoder to decode audio data that includes a number, denoted N.n of channels of encoded audio data, e.g., an E-AC-3 audio decoder to decode E-AC-3 encoded audio data to form decoded audio data that includes M.m channels of decoded audio, n=0 or 1, m=0 or 1, and M>1. n=1 indicates an input LFE channel, m=1 indicates an output LFE channel. M<N indicates downmixing, M>N indicates upmixing.

The method includes accepting the audio data that includes N.n channels of encoded audio data, encoding by the encoding method, e.g., by an encoding method that includes transforming using an overlapped-transform N channels of digital audio data, forming and packing frequency domain exponent and mantissa data, and forming and packing metadata related to the frequency domain exponent and mantissa data, the metadata optionally including metadata related to transient pre-noise processing, e.g., by an E-AC-3 encoding method.

Some embodiments described herein are designed to accept encoded audio data encoded according to the E-AC-3 standard or according to a standard backwards compatible with the E-AC-3 standard, and may include more than 5 coded main channels.

As will be described in more detail below, the method includes decoding the accepted audio data, decoding including: unpacking the metadata and unpacking and decoding the frequency domain exponent and mantissa data; determining transform coefficients from the unpacked and decoded frequency domain exponent and mantissa data; inverse transforming the frequency domain data; applying windowing and overlap-add to determine sampled audio data; applying any required transient pre-noise processing decoding according to the metadata related to transient pre-noise processing; and, in the case M<N, downmixing according to downmixing data. The downmixing includes testing whether the downmixing data are changed from previously used downmixing data, and, if changed, applying cross-fading to determine cross-faded downmixing data and downmixing according to the cross-faded downmixing data, and if unchanged, directly downmixing according to the downmixing data.

In some embodiments of the present invention, the decoder uses at least one x86 processor that executes streaming single-instruction-multiple-data (SIMD) extensions (SSE) instructions, including vector instructions. In such embodiments, the downmixing includes running vector instructions on at least one of the one or more x86 processors.

In some embodiments of the present invention, the decoding method for E-AC-3 audio, which might be AC-3 audio, is partitioned into modules of operations that can be applied more than once, i.e., instantiated more than once in different decoder implementations. In the case of a method that includes decoding, the decoding is partitioned into a set of front-end decode (FED) operations, and a set of back-end decode (BED) operations. As will be detailed below, the front-end decode operations including unpacking and decoding frequency domain exponent and mantissa data of a frame of an AC-3 or E-AC-3 bitstream into unpacked and decoded frequency domain exponent and mantissa data for the frame, and the frame's accompanying metadata. The back-end decode operations include determining of the transform coefficients, inverse transforming the determined transform coefficients, applying windowing and overlap-add operations, applying any required transient pre-noise processing decoding, and applying downmixing in the case there are fewer output channels than coded channels in the bitstream.

Some embodiments of the present invention include a computer-readable storage medium storing instructions that when executed by one or more processors of a processing system cause the processing system to carry out decoding of audio data that includes N.n channels of encoded audio data, to form decoded audio data that includes M.m channels of decoded audio, M≥1. In today's standards, n=0 or 1 and m=0 or 1, but the invention is not so limited. The instructions include instructions that when executed cause accepting the audio data that includes N.n channels of encoded audio data encoded by an encoding method, e.g., AC-3 or E-AC-3. The instructions further include instructions that when executed cause decoding the accepted audio data.

In some such embodiments, the accepted audio data are in the form of an AC-3 or E-AC-3 bitstream of frames of coded data. The instructions that when executed cause decoding the accepted audio data are partitioned into a set of reusable modules of instructions, including a front-end decode (FED) module, and a back-end decode (BED) module. The front-end decode module including instructions that when executed cause carrying out the unpacking and decoding the frequency domain exponent and mantissa data of a frame of the bitstream into unpacked and decoded frequency domain exponent and mantissa data for the frame, and the frame's accompanying metadata. The back-end decode module including instructions that when executed cause determining of the transform coefficients, inverse transforming, applying windowing and overlap-add operations, applying any required transient pre-noise processing decoding, and applying downmixing in the case that there are fewer output channels than input coded channels.

FIGS. 2A-2D show in simplified block diagram forms some different decoder configurations that can advantageously use one or more common modules. FIG. 2A shows a simplified block diagram of an example E-AC-3 decoder 200 for AC-3 or E-AC-3 coded 5.1 audio. Of course the use of the term "block" when referring to blocks in a block diagram is not the same as a block of audio data, the latter referring to an amount of audio data. Decoder 200 includes a front-end decode (FED) module 201 that is to accept AC-3 or E-AC-3 frames and to carry out, frame by frame, unpacking of the frame's metadata and decoding of the frame's audio data to frequency domain exponent and mantissa data. Decoder 200 also includes a back-end decode (BED) module 203 that accepts the frequency domain exponent and mantissa data from the front-end decode module 201 and decodes it to up to 5.1 channels of PCM audio data.

The decomposition of the decoder into a front-end decode module and a back-end decode module is a design choice, not a necessary partitioning. Such partitioning does provide benefits of having common modules in several alternate configurations. The FED module can be common to such alternate configurations, and many configurations have in common the unpacking of the frame's metadata and decoding of the frame's audio data to frequency domain exponent and mantissa data as carried out by an FED module.

Figure 2B:
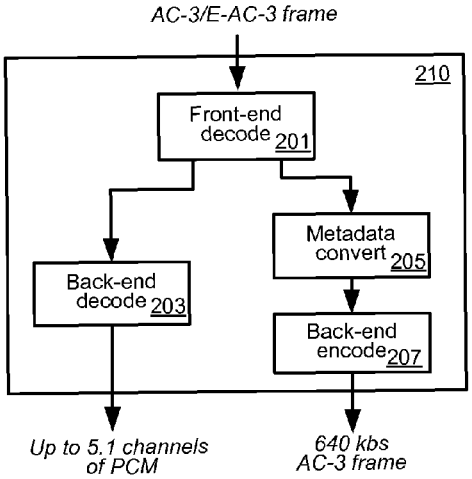

As one example of an alternate configuration, FIG. 2B shows a simplified block diagram of an E-AC-3 decoder/converter 210 for E-AC-3 coded 5.1 audio that both decodes AC-3 or E-AC-3 coded 5.1 audio, and also converts an E-AC-3 coded frame of up to 5.1 channels of audio to an AC-3 coded frame of up to 5.1 channels. Decoder/converter 210 includes a front-end decode (FED) module 201 that accepts AC-3 or E-AC-3 frames and to carry out, frame by frame, unpacking of the frame's metadata and decoding of the frame's audio data to frequency domain exponent and mantissa data. Decoder/converter 210 also includes a back-end decode (BED) module 203 that is the same as or similar to the BED module 203 of decoder 200, and that accepts the frequency domain exponent and mantissa data from the front-end decode module 201 and decodes it to up to 5.1 channels of PCM audio data. Decoder/converter 210 also includes a metadata converter module 205 that converts metadata and a back-end encode module 207 that accepts the frequency domain exponent and mantissa data from the front-end decode module 201 and to encode the data as an AC-3 frame of up to 5.1 channels of audio data at no more than the maximum data rate of 640 kbps possible with AC-3.

Figure 2C:
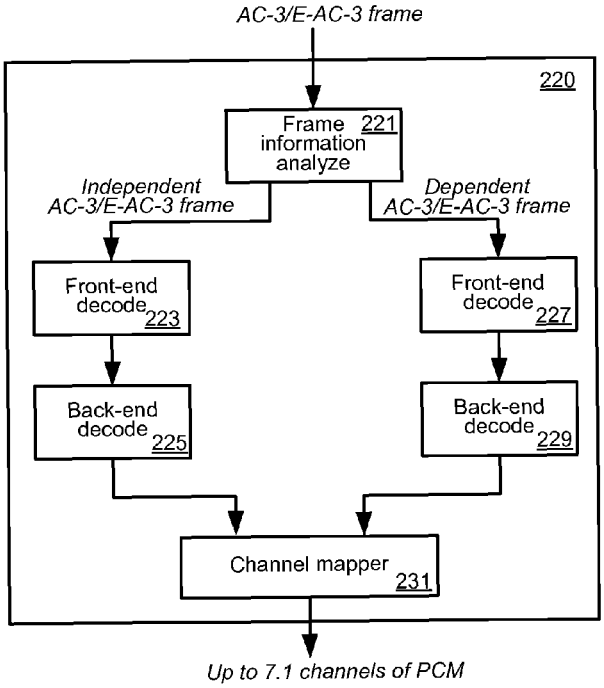
Figure 2D:
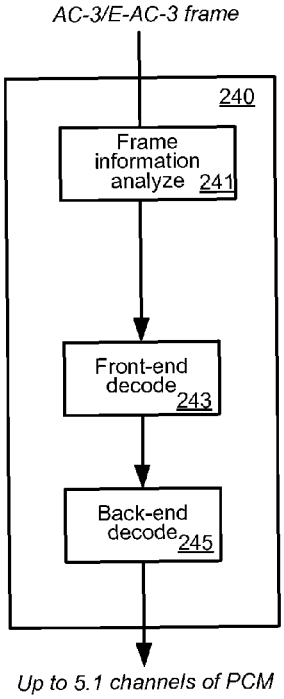

As one example of an alternate configuration, FIG. 2C shows a simplified block diagram of an E-AC-3 decoder that decodes an AC-3 frame of up to 5.1 channels of coded audio and also to decode an E-AC-3 coded frame of up to 7.1 channels of audio. Decoder 220 includes a frame information analyze module 221 that unpacks the BSI data and identifies the frames and frame types and provides the frames to appropriate front-end decoder elements. In a typical implementation that includes one or more processors and memory in which instructions are stored that when executed cause carrying out of the functionality of the modules, multiple instantiations of a front-end decode module, and multiple instantiations of a back-end decode module may be operating. In some embodiments of an E-AC-3 decoder, the BSI unpacking functionality is separated from the front-end decode module to look at the BSI data. That provides for common modules to be used in various alternate implementations. FIG. 2C shows a simplified block diagram of a decoder with such architecture suitable for up to 7.1 channels of audio data. FIG. 2D shows a simplified block diagram of a 5.1 decoder 240 with such architecture. Decoder 240 includes a frame information analyze module 241, a front-end decode module 243, and a back-end decode module 245. These FED and BED modules can be similar in structure to FED and BED modules used in the architecture of FIG. 2C.

Returning to FIG. 2C, the frame information analyze module 221 provides the data of an independent AC-3/E-AC3 coded frame of up to 5.1 channels to a front-end decode module 223 that accepts AC-3 or E-AC-3 frames and to carry out, frame by frame, unpacking of the frame's metadata and decoding of the frame's audio data to frequency domain exponent and mantissa data. The frequency domain exponent and mantissa data are accepted by a back-end decode module 225 that is the same as or similar to the BED module 203 of decoder 200, and that accept the frequency domain exponent and mantissa data from the front-end decode module 223 and to decode the data to up to 5.1 channels of PCM audio data. Any dependent AC-3/E-AC3 coded frame of additional channel data are provided to another front-end decode module 227 that is similar to the other FED module, and so unpacks the frame's metadata and decode the frame's audio data to frequency domain exponent and mantissa data. A back-end decode module 229 that accepts the data from FED module 227 and to decode the data to PCM audio data of any additional channels. A PCM channel mapper module 231 is used to combine the decoded data from the respective BED modules to provide up to 7.1 channels of PCM data.

If there are more than 5 coded main channels, i.e., case N>5, e.g., there are 7.1 coded channels, the coded bitstream includes an independent frame of up to 5.1 coded channels and at least one dependent frame of coded data. In software embodiments for such a case, e.g., embodiments comprising a computer-readable medium that stores instructions for execution, the instructions are arranged as a plurality of 5.1 channel decode modules, each 5.1 channel decode module including a respective instantiation of a front-end decode module and a respective instantiation of a back-end decode module. The plurality of 5.1 channel decode modules includes a first 5.1 channel decode module that when executed causes decoding of the independent frame, and one or more other channel decode modules for each respective dependent frame. In some such embodiments, the instructions include a frame information analyze module of instructions that when executed causes unpacking the Bit Stream Information (BSI) field from each frame to identify the frames and frame types and provides the identified frames to the appropriate front-end decoder module instantiation, and a channel mapper module of instructions that when executed and in the case N>5 cause combining the decoded data from respective back-end decode modules to form the N main channels of decoded data.

A Method for Operating an AC-3/E-AC-3 Dual Decoder Converter.

One embodiment of the invention is in the form of a dual decoder converter (DDC) that decodes two AC-3/E-AC-3 input bitstreams, designated as "main" and "associated," with up to 5.1 channels each, to PCM audio, and in the case of conversion, converts the main audio bitstream from E-AC-3 to AC-3, and in the case of decoding, decodes the main bitstream and if present associated bitstream. The dual decoder converter optionally mixes the two PCM outputs using mixing metadata extracted from the associated audio bitstream.

One embodiment of the dual decoder converter carries out a method of operating a decoder to carry out the processes included in decoding and/or converting the up to two AC-3/E-AC-3 input bitstreams. Another embodiment is in the form of a tangible storage medium having instructions, e.g., software instructions thereon, that when executed by one or more processors of a processing system, causes the processing system to carry out the processes included in decoding and/or converting the up to two AC-3/E-AC-3 input bitstreams.

One embodiment of the AC-3/E-AC-3 dual decoder converter has six subcomponents, some of which include common subcomponents. The modules are:

- Decoder-converter: The decoder-converter is configured when executed to decode an AC-3/E-AC-3 input bitstream (up to 5.1 channels) to PCM audio, and/or to convert the input bitstream from E-AC-3 to AC-3. The decoder-converter has three main subcomponents, and can implement an embodiment 210 shown in FIG. 2B above. The main subcomponents are:
  - Front-end decode: The FED module is configured, when executed, to decode a frame of an AC-3/E-AC-3 bitstream into raw frequency domain audio data and its accompanying metadata.
  - Back-end decode: The BED is module is configured, when executed, to complete the rest of the decode process that was initiated by the FED module. In particular, the BED module decodes the audio data (in mantissa and exponent format) into PCM audio data.
  - Back-end encode: The back-end encode module is configured, when executed to encode an AC-3 frame using six blocks of audio data from the FED. The back-end encode module is also configured, when executed, to synchronize, resolve and convert E-AC-3 metadata to Dolby Digital metadata using an included metadata converter module.
- 5.1 Decoder: The 5.1 decoder module is configured when executed to decode an AC-3/E-AC-3 input bitstream (up to 5.1 channels) to PCM audio. The 5.1 decoder also optionally outputs mixing metadata for use by an external application to mix two AC-3/E-AC-3 bitstreams. The decoder module includes two main subcomponents: an FED module as described herein above and a BED module as described herein above. A block diagram of an example 5.1 decoder is shown in FIG. 2D.
- Frame information: The frame information module is configured when executed to parse an AC-3/E-AC-3 frame and unpack its bitstream information. A CRC check is performed on the frame as part of the unpacking process.
- Buffer descriptors: The buffer descriptors module contains AC-3, E-AC-3 and PCM buffer descriptions and functions for buffer operations.
- Sample rate converter: The sample rate converter module is optional, and configured, when executed to upsample PCM audio by a factor of two.
- External mixer: The external mixer module is optional, and configured when executed to mix a main audio program and an associated audio program to a single output audio program using mixing metadata supplied in the associated audio program.

Front-End Decode Module Design

The front-end decode module decodes data according to AC-3's methods, and according to E-AC-3 additional decoding aspects, including decoding AHT data for stationary signals, E-AC-3's enhanced channel coupling, and spectral extension.

In the case of an embodiment in the form of a tangible storage medium, the front-end decode module comprises software instructions stored in a tangible storage medium that when executed by one or more processors of a processing system, cause the actions described in the details provided herein for the operation of the front-end decode module. In a hardware implementation, the front-end decode module includes elements that are configured in operation to carry out the actions described in the details provided herein for the operation of the front-end decode module.

In AC-3 decoding, block-by-block decoding is possible. With E-AC-3, the first audio block-audio block 0 of a frame includes the AHT mantissas of all 6 blocks. Hence, block-by-block decoding typically is not used, but rather several blocks are processed at once. The processing of actual data, however, is of course carried out on each block.

In one embodiment, in order to use a uniform method of decoding/architecture of a decoder regardless of whether the AHT is used, the FED module carries out, channel-by-channel, two passes. A first pass includes unpacking metadata block-by-block and saving pointers to where the packed exponent and mantissa data are stored, and a second pass includes using the saved pointers to the packed exponents and mantissas, and unpacking and decoding exponent and mantissa data channel-by-channel.

FIG. 3 shows a simplified block diagram of one embodiment of a front-end decode module, e.g., implemented as a set of instructions stored in a memory that when executed causes FED processing to be carried out. FIG. 3 also shows pseudocode for instructions for a first pass of two-pass front-end decode module 300, as well as pseudocode for instructions for the second pass of two-pass front-end decode module. The FED module includes the following modules, each including instructions, some such instructions being definitional in that they define structures and parameters:

- Channel: The channel module defines structures for representing an audio channel in memory and provides instructions to unpack and decode an audio channel from an AC-3 or E-AC-3 bitstream.
- Bit allocation: The bit allocation module provides instructions to calculate the masking curve and calculate the bit allocation for coded data.
- Bitstream operations: The bitstream operations module provides instructions for unpacking data from an AC-3 or E-AC-3 bitstream.
- Exponents: The exponents module defines structures for representing exponents in memory and provides instructions configured when executed to unpack and decode exponents from an AC-3 or E-AC-3 bitstream.
- Exponents and mantissas: The exponents and mantissas module defines structures for representing exponents and mantissas in memory and provides instructions configured when executed to unpack and decode exponents and mantissas from an AC-3 or E-AC-3 bitstream.
- Matrixing: The matrixing module provides instructions configured when executed to support dematrixing of matrixed channels.
- Auxiliary data: The auxiliary data module defines auxiliary data structures used in the FED module to carry out FED processing.
- Mantissas: The mantissas module defines structures for representing mantissas in memory and provides instructions configured when executed to unpack and decode mantissas from an AC-3 or E-AC-3 bitstream.

Adaptive hybrid transform: The AHT module provides instructions configured when executed to unpack and decode adaptive hybrid transform data from an E-AC-3 bitstream.

Audio frame: The audio frame module defines structures for representing an audio frame in memory and provides instructions configured when executed to unpack and decode an audio frame from an AC-3 or E-AC-3 bitstream.

Enhanced coupling: The enhanced coupling module defines structures for representing an enhanced coupling channel in memory and provides instructions configured when executed to unpack and decode an enhanced coupling channel from an AC-3 or E-AC-3 bitstream. Enhanced coupling extends traditional coupling in an E-AC-3 bitstream by providing phase and chaos information.

Audio block: The audio block module defines structures for representing an audio block in memory and provides instructions configured when executed to unpack and decode an audio block from an AC-3 or E-AC-3 bitstream.

Spectral extension: The spectral extension module provides support for spectral extension decoding in an E-AC-3 bitstream.

Coupling: The coupling module defines structures for representing a coupling channel in memory and provides instructions configured when executed to unpack and decode a coupling channel from an AC-3 or E-AC-3 bitstream.

Figure 4:
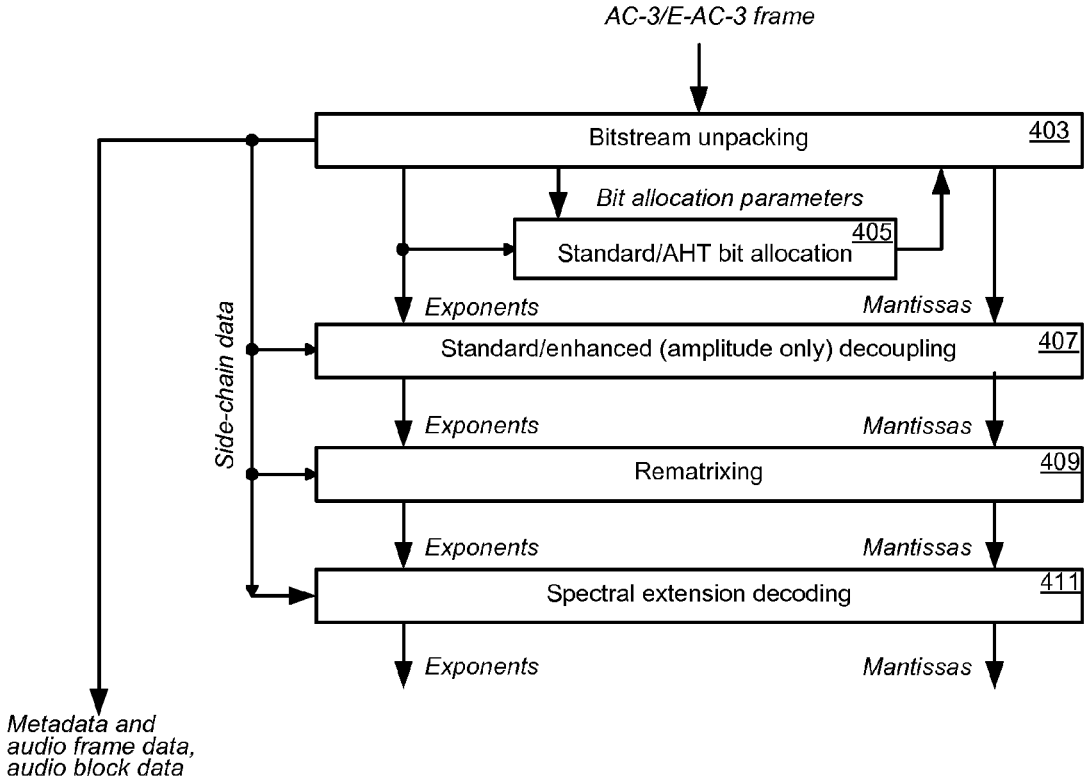
FIG. 4 shows a simplified data flow diagram for the operation of one embodiment of a front-end decode module.

FIG. 4 shows a simplified data flow diagram for the operation of one embodiment of the front-end decode module 300 of FIG. 3 that describes how the pseudocode and sub-modules elements shown in FIG. 3 cooperate to carry out the functions of a front-end decode module. By a functional element is meant an element that carries out a processing function. Each such element may be a hardware element, or a processing system and a storage medium that includes instructions that when executed carry out the function. A bitstream unpacking functional element 403 accepts an AC-3/E-AC-3 frame and generates bit allocation parameters for a standard and/or AHT bit allocation functional element 405 that produces further data for the bitstream unpacking to ultimately generate exponent and mantissa data for an included standard/enhanced decoupling functional element 407. The functional element 407 generates exponent and mantissa data for an included rematrixing functional element 409 to carry out any needed rematrixing. The functional element 409 generates exponent and mantissa data for an included spectral extension decoding functional element 411 to carry out any needed spectral extension. Functional elements 407 to 411 use data obtained by the unpacking operation of the functional element 403. The result of the front-end decoding is exponent and mantissa data as well as additional unpacked audio frame parameters and audio block parameters.

Referring in more detail to the first pass and second pass pseudocode shown in FIG. 3, the first pass instructions are configured, when executed to unpack metadata from an AC-3/E-AC-3 frame. In particular, the first pass includes unpacking the BSI information, and unpacking the audio frame information. For each block, starting with block 0 to block 5 (for 6 blocks per frame), the fixed data are unpacked, and for each channel, a pointer to the packed exponents in the bitstream is saved, exponents are unpacked, and the position in the bitstream at which the packed mantissas reside is saved. Bit allocation is computed, and, based on bit allocation, mantissas may be skipped.

The second pass instructions are configured, when executed, to decode the audio data from a frame to form mantissa and exponent data. For each block starting with block 0, unpacking includes loading the saved pointer to packed exponents, and unpacking the exponents pointed thereby, computing bit allocation, loading the saved pointer to packed mantissas, and unpacking the mantissas pointed thereby. Decoding includes performing standard and enhanced decoupling and generating the spectral extension band(s), and, in order to be independent from other modules, transferring the resulting data into a memory, e.g., a memory external to the internal memory of the pass so that the resulting data can be accessed by other modules, e.g., the BED module. This memory, for convenience, is called the "external" memory, although it may, as would be clear to those skilled in the art, be part of a single memory structure used for all modules.

In some embodiments, for exponent unpacking, the exponents unpacked during first pass are not saved in order to minimize memory transfers. If AHT is in use for a channel, the exponents are unpacked from block 0 and copied to the other five blocks, numbered 1 to 5. If AHT is not in use for a channel, pointers to packed exponents are saved. If the channel exponent strategy is to reuse exponents, the exponents are unpacked again using the saved pointers.

In some embodiments, for coupling mantissa unpacking, if the AHT is used for the coupling channel, all six blocks of AHT coupling channel mantissas are unpacked in block 0, and dither regenerated for each channel that is a coupled channel to produce uncorrelated dither. If the AHT is not used for the coupling channel, pointers to the coupling mantissas are saved. These saved pointers are used to re-unpack the coupling mantissas for each channel that is a coupled channel in a given block.

Back-End Decode Module Design

The back-end decode (BED) module is operative to take frequency domain exponent and mantissa data and to decode it to PCM audio data. The PCM audio data are rendered based on user selected modes, dynamic range compression, and downmix modes.

In some embodiments, in which the front-end decode module stores exponent and mantissa data in a memory—we call it the external memory—separate from the working memory of the front-end module, the BED module uses block-by-block frame processing to minimize downmix and delay buffer requirements, and, to be compatible with the output of the front-end module, uses transfers from the external memory to access exponent and mantissa data to process.

In the case of an embodiment in the form of a tangible storage medium, the back-end decode module comprises software instructions stored in a tangible storage medium that when executed by one or more processors of a processing system, cause the actions described in the details provided herein for the operation of the back-end decode module. In a hardware implementation, the back-end decode module includes elements that are configured in operation to carry out the actions described in the details provided herein for the operation of the back-end decode module.

FIG. 5A shows a simplified block diagram of one embodiment of a back-end decode module 500 implemented as a set of instructions stored in a memory that when executed causes BED processing to be carried out. FIG. 5A also shows pseudocode for instructions for the back-end decode module 500. The BED module 500 includes the following modules, each including instructions, some such instructions being definitional:

Dynamic range control: The dynamic range control module provides instructions, that when executed cause carrying out functions for controlling the dynamic range of the decoded signal, including applying gain ranging, and applying dynamic range control.

Transform: The transform module provides instructions, that when executed cause carrying out the inverse transforms, including carrying out an inverse modified discrete cosine transform (IMDCT), which includes carrying out pre-rotation used for calculating the inverse DCT transform, carrying post-rotation used for calculating the inverse DCT transform, and determining the inverse fast Fourier transform (IFFT).

Transient pre-noise processing: The transient pre-noise processing module provides instructions, that when executed cause carrying out transient pre-noise processing.

Window & overlap-add: The window and overlap-add module with delay buffer provides instructions, that when executed cause carrying out the windowing, and the overlap/add operation to reconstruct output samples from inverse transformed samples.

Time domain (TD) downmix: The TD downmix module provides instructions, that when executed cause carrying out downmixing in the time domain as needed to a fewer number of channels.

Figure 6:
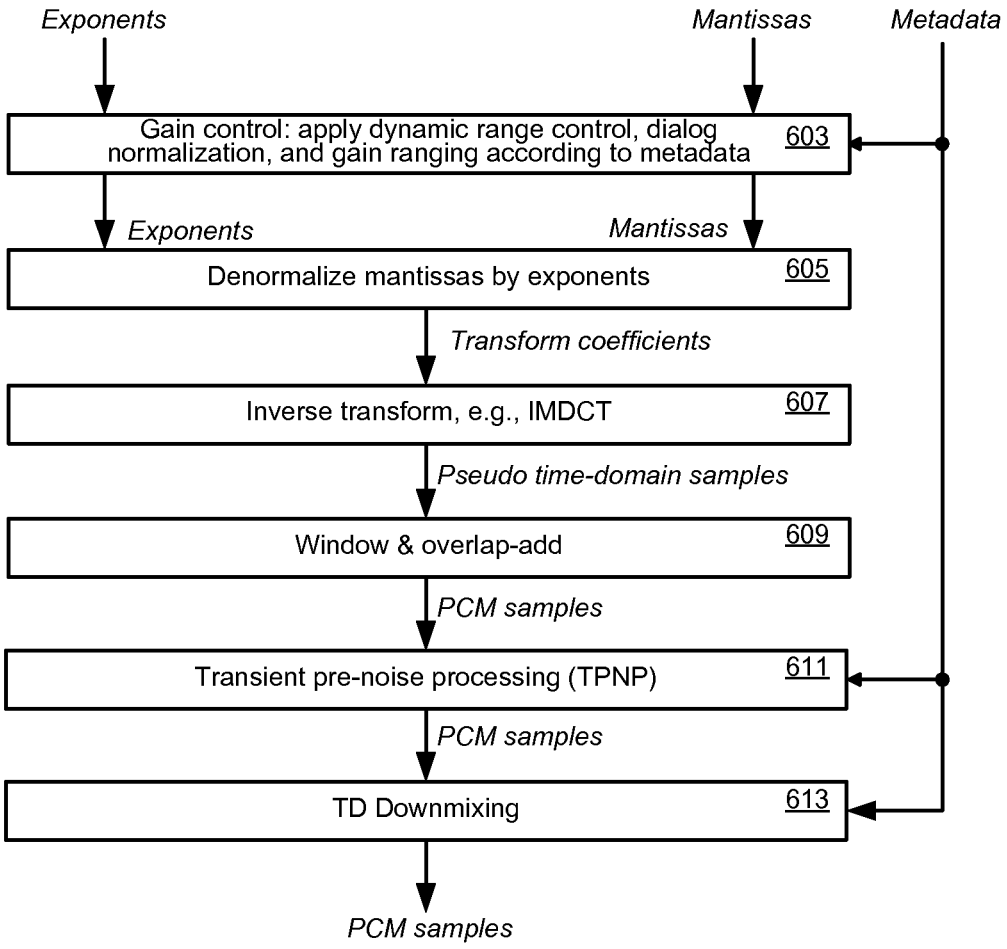
FIG. 6 shows a simplified data flow diagram for the operation of one embodiment of a back-end decode module.

FIG. 6 shows a simplified data flow diagram for the operation of one embodiment of the back-end decode module 500 of FIG. 5A that describes how the code and sub-modules elements shown in FIG. 5A cooperate to carry out the functions of a back-end decode module. A gain control functional element 603 accepts exponent and mantissa data from the front-end decode module 300 and applies any required dynamic range control, dialog normalization, and gain ranging according to metadata. The resulting exponent and mantissa data are accepted by a denormalize mantissa by exponents functional element 605 that generates the transform coefficients for inverse transforming. An inverse transform functional element 607 applies the IMDCT to the transform coefficients to generate time samples that are pre-windowing and overlap-add. Such pre overlap-add time domain samples are called "pseudo-time domain" samples herein, and these samples are in what is called herein the pseudo-time domain. These are accepted by a windowing and overlap-add functional element 609 that generates PCM samples by applying windowing and overlap-add operations to the pseudo-time domain samples. Any transient pre-noise processing is applied by a transient pre-noise processing functional element 611 according to metadata. If specified, e.g., in the metadata or otherwise, the resulting post transient pre-noise processing PCM samples are downmixed to the number M.m of output channels of PCM samples by a Downmixing functional element 613.

Referring again to FIG. 5A, the pseudocode for the BED module processing includes, for each block of data, transferring the mantissa and exponent data for blocks of a channel from the external memory, and, for each channel: applying any required dynamic range control, dialog normalization, and gain ranging according to metadata; denormalizing mantissas by exponents to generate the transform coefficients for inverse transforming; computing an IMDCT to the transform coefficients to generate pseudo-time domain samples; applying windowing and overlap-add operations to the pseudo-time domain samples; applying any transient pre-noise processing according to metadata; and, if required, time domain downmixing to the number M.m of output channels of PCM samples.

Embodiments of decoding shown in FIG. 5A include carrying out such gain adjustments as applying dialogue normalization offsets according to metadata, and applying dynamic range control gain factors according to metadata. Performing such gain adjustments at the stage that data are provided in mantissa and exponent form in the frequency domain is advantageous. The gain changes may vary over time, and such gain changes made in the frequency domain results in smooth cross-fades once the inverse transform and windowing/overlap-add operations have occurred.

Transient Pre-Noise Processing

E-AC-3 encoding and decoding were designed to operate and provide better audio quality at lower data rates than in AC-3. At lower data rates the audio quality of coded audio can be negatively impacted, especially for relatively difficult-to-code, transient material. This impact on audio quality is primarily due to the limited number of data bits available to accurately code these types of signals. Coding artifacts of transients are exhibited as a reduction in the definition of the transient signal as well as the "transient pre-noise" artifact which smears audible noise throughout the encoding window due to coding quantization errors.

As described above and in FIGS. 5 and 6, the BED provides for transient pre-noise processing. E-AC-3 encoding includes transient pre-noise processing coding, to reduce transient pre-noise artifacts that may be introduced when audio containing transients is encoded by replacing the appropriate audio segment with audio that is synthesized using the audio located prior to the transient pre-noise. The audio is processed using time scaling synthesis so that its duration is increased such that it is of appropriate length to replace the audio containing the transient pre-noise. The audio synthesis buffer is analyzed using audio scene analysis and maximum similarity processing and then time scaled such that its duration is increased enough to replace the audio which contains the transient pre-noise. The synthesized audio of increased length is used to replace the transient pre-noise and is cross-faded into the existing transient pre-noise just prior to the location of the transient to ensure a smooth transition from the synthesized audio into the originally coded audio data. By using transient pre-noise processing, the length of the transient pre-noise can be dramatically reduced or removed, even for the case when block-switching is disabled.

In one E-AC-3 encoder embodiment, time scaling synthesis analysis and processing for the transient pre-noise processing tool is performed on time domain data to determine metadata information, e.g., including time scaling parameters. The metadata information is accepted by the decoder along with the encoded bitstream. The transmitted transient pre-noise metadata are used to perform time domain processing on the decoded audio to reduce or remove the transient pre-noise introduced by low bit-rate audio coding at low data rates.

The E-AC-3 encoder performs time scaling synthesis analysis and determines time scaling parameters, based on the audio content, for each detected transient. The time scaling parameters are transmitted as additional metadata, along with the encoded audio data.

At an E-AC-3 decoder, the optimal time scaling parameters provided in E-AC-3 metadata are accepted as part of accepted E-AC-3 metadata for use in transient pre-noise processing. The decoder performs audio buffer splicing and cross-fading using the transmitted time scaling parameters obtained from the E-AC-3 metadata.

By using the optimal time scaling information and applying it with the appropriate cross-fading processing, the transient pre-noise introduced by low-bit rate audio coding can be dramatically reduced or removed in the decoding.

Thus, transient pre-noise processing overwrites pre-noise with a segment of audio that most closely resembles the original content. The transient pre-noise processing instructions, when executed, maintain a four-block delay buffer for use in copy over. The transient pre-noise processing instructions, when executed, in the case where overwriting occurs, cause performing a cross fade in and out on overwritten pre-noise.

Downmixing

Denote by N.n the number of channels encoded in the E-AC-3 bitstream, where N is the number of main channels, and n=0 or 1 is the number of LFE channels. Often, it is desired to downmix the N main channels to a smaller number, denoted M, of output main channels. Downmixing from N to M channels, M<N is supported by embodiments of the present invention. Upmixing also is possible, in which case M>N.

Thus, in the most general implementation, audio decoder embodiments are operative to decode audio data that includes N.n channels of encoded audio data to decode audio data that includes M.m channels of decoded audio, and M≥1, with n, m indicating the number of LFE channels in the input, output respectively. Downmixing is the case M<N and according to a set of downmixing coefficients is included in the case M<N.

Frequency Domain Vs. Time Domain Downmixing.

Downmixing can be done entirely in the frequency domain, prior to the inverse transform, in the time domain after the inverse transform but, in the case of overlap-add block processing prior to the windowing and overlap-add operations, or in the time domain after the windowing and overlap-add operation.

Frequency domain (FD) downmixing is much more efficient than time domain downmixing. Its efficiency stems, e.g., from the fact that any processing steps subsequent to the downmixing step are only carried out on the remaining number of channels, which is generally lower after the downmixing. Thus, the computational complexity of all processing steps subsequent to the downmixing step is reduced by at least the ratio of input channels to output channels.

As an example, consider a 5.0 channel to stereo downmix. In this case, the computational complexity of any subsequent processing step will be reduced by approximately a factor of 5/2=2.5.

Time domain (TD) downmixing is used in typical E-AC-3 decoders and in the embodiments described above and illustrated with FIGS. 5A and 6. There are three main reasons that typical E-AC-3 decoders use time domain downmixing:

Channels with Different Block Types

Depending on the to-be-encoded audio content, an E-AC-3 encoder can choose between two different block types—short block and long block—to segment the audio data. Harmonic, slowly changing audio data is typically segmented and encoded using long blocks, whereas transient signals are segmented and encoded in short blocks. As a result, the frequency domain representation of short blocks and long blocks is inherently different and cannot be combined in a frequency domain downmixing operation.

Only after the block type specific encoding steps are undone in the decoder, the channels can be mixed together. Thus, in the case of block-switched transforms, a different partial inverse transform process is used, and the results of the two different transforms cannot be directly combined until just prior to the window stage.

Methods are known, however, for first converting the short-length transform data to the longer frequency domain data, in which case, the downmixing can be carried out in the frequency domain. Nevertheless, in most known decoder implementations, downmixing is carried out post inverse transforming according to downmixing coefficients.

Up-mix

If the number of output main channels is higher than the number of input main channels, M>N, a time domain mixing approach is beneficial, as this moves the up-mixing step towards the end of the processing, reducing the number of channels in processing.

TPNP

Blocks that are subject to transient pre-noise processing (TPNP) may not be downmixed in the frequency domain, because TPNP operates in the time domain. TPNP requires a history of up to four blocks of PCM data (1024 samples), which must be present for the channel in which TPNP is applied. Switching to time domain downmix is hence necessary to fill up the PCM data history and to perform the pre-noise substitution.

Hybrid Downmixing Using Both Frequency Domain and Time Domain Downmixing

The inventors recognize that channels in most coded audio signals use the same block type for more than 90% of the time. That means that the more efficient frequency domain downmixing would work for more than 90% of the data in typical coded audio, assuming there is no TPNP. The remaining 10% or less would require time domain downmixing as occurs in typical prior art E-AC-3 decoders.

Embodiments of the present invention include downmix method selection logic to determine block-by-block which downmixing method to apply, and both time domain downmixing logic, and frequency domain downmixing logic to apply the particular downmixing method as appropriate. Thus a method embodiment includes determining block by block whether to apply frequency domain downmixing or time domain downmixing. The downmix method selection logic operates to determine whether to apply frequency domain downmixing or time domain downmixing, and includes determining if there is any transient pre-noise processing, and determining if any of the N channels have a different block type. The selection logic determines that frequency domain downmixing is to be applied only for a block that has the same block type in the N channels, no transient pre-noise processing, and M<N.

FIG. 5B shows a simplified block diagram of one embodiments of a back-end decode module 520 implemented as a set of instructions stored in a memory that when executed causes BED processing to be carried out. FIG. 5B also shows pseudocode for instructions for the back-end decode module 520. The BED module 520 includes the modules shown in FIG. 5A that only use time domain downmixing, and the following additional modules, each including instructions, some such instructions being definitional:

Downmix method selection module that checks for (i) change of block type; (ii) whether there is no true downmixing (M<N), but rather upmixing, and (iii) whether the block is subject to TPNP, and if none of these is true, selecting frequency domain downmixing. This module carries out determining block by block whether to apply frequency domain downmixing or time domain downmixing.

Frequency domain downmix module that carries out, after denormalization of the mantissas by exponents, frequency domain downmixing. Note that the Frequency domain downmix module also includes a time domain to frequency domain transition logic module that checks whether the preceding block used time domain downmix, in which case the block is handled differently as described in more detail below. In addition, the transition logic module also deals with processing steps associated with certain, non-regularly reoccurring events, e.g. program changes such as fading out channels.

FD to TD downmix transition logic module that checks whether the preceding block used frequency domain downmix, in which case the block is handled differently as described in more detail below. In addition, the transition logic module also deals with processing steps associated with certain, non-regularly reoccurring events, e.g. program changes such as fading out channels.

Furthermore, the modules that are in FIG. 5A might behave differently in embodiments that include hybrid downmixing, i.e., both FD and TD downmixing depending on one or more conditions for the current block.

Referring to the pseudocode of FIG. 5B, some embodiments of the back end decoding method include, after transferring the data of a frame of blocks from external memory, ascertaining whether FD downmixing or TD downmixing. For FD downmixing, for each channel, the method includes (i) applying dynamic range control and dialog normalization, but, as discussed below, disabling gain ranging; (ii) denormalizing mantissas by exponents; (iii) carrying out FD downmixing; and (iv) ascertaining if there are fading out channels or if the previous block was downmixed by time domain downmixing, in which case, the processing is carried out differently as described in more detail below. For the case of TD downmixing, and also for FD downmixed data, the process includes for each channel: (i) processing differently blocks to be TD downmixed in the case the previous block was FD downmixed and also handling any program changes; (ii) determining the inverse transform (iii). Carrying out window overlap add; and, in the case of TD downmixing, (iv) performing any TPNP and downmixing to the appropriate output channel.

Figure 7:
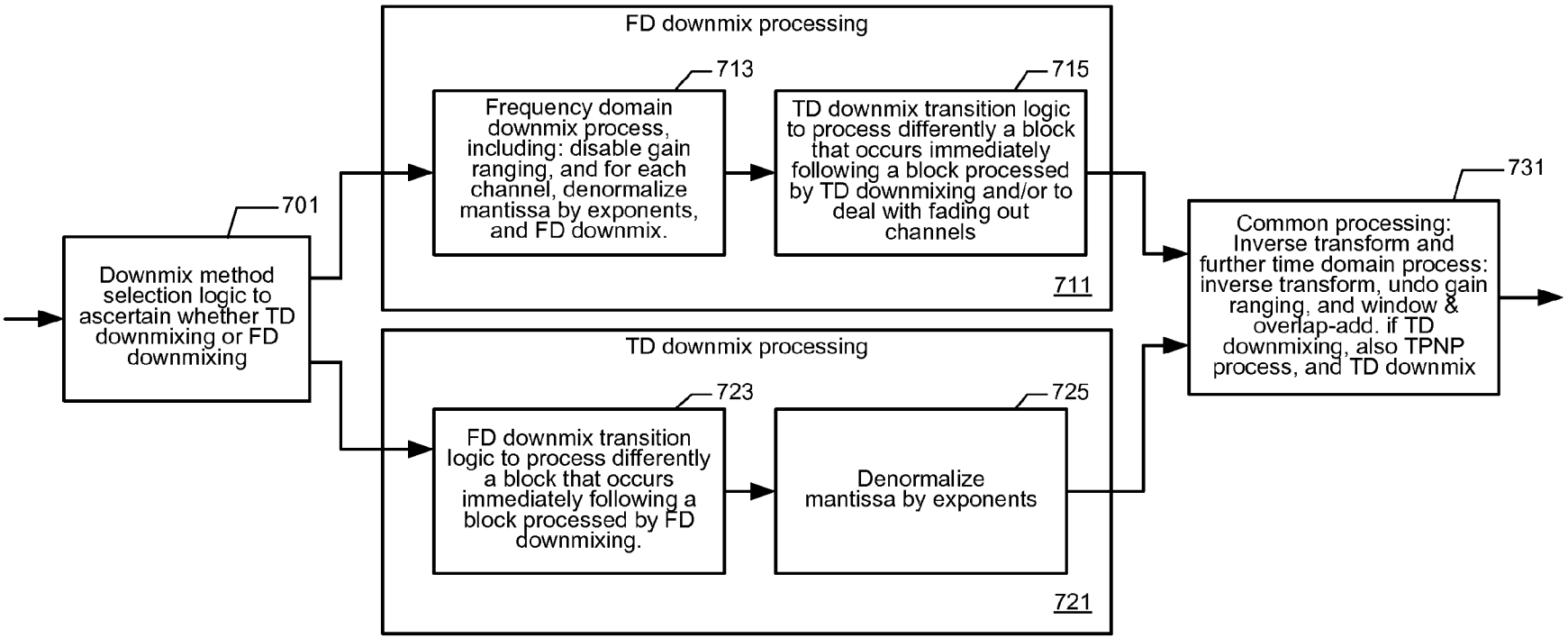
FIG. 7 shows a simplified data flow diagram for the operation of another embodiment of a back-end decode module.

FIG. 7 shows a simple data flow diagram. Block 701 corresponds to the downmix method selection logic that tests for the three conditions: block type change, TPNP, or upmixing, and any condition is true, directs the dataflow to a TD downmixing branch 721 that includes in 723 FD downmix transition logic to process differently a block that occurs immediately following a block processed by FD downmixing, program change processing, and in 725 denormalizing the mantissa by exponents. The dataflow after block 721 is processed by common processing block 731. If the downmix method selection logic block 701 tests determines the block is for FD downmixing the dataflow branches to FD downmixing processing 711 that includes a frequency domain downmix process 713 that disables gain ranging, and for each channel, denormalizes the mantissas by exponents and carries out FD downmixing, and a TD downmix transition logic block 715 to determine whether the previous block was processed by TD downmixing, and to process such a block differently, and also to detect and handle any program changes, such as fading out channels. The dataflow after the TD downmix transition block 715 is to the same common processing block 731.

The common processing block 731 includes inverse transforming and any further time domain processing. The further time domain processing includes undoing gain ranging, and windowing and overlap- and processing. If the block is from the TD downmixing block 721, the further time domain processing further includes any TPNP processing and time domain downmixing.

Figure 8:
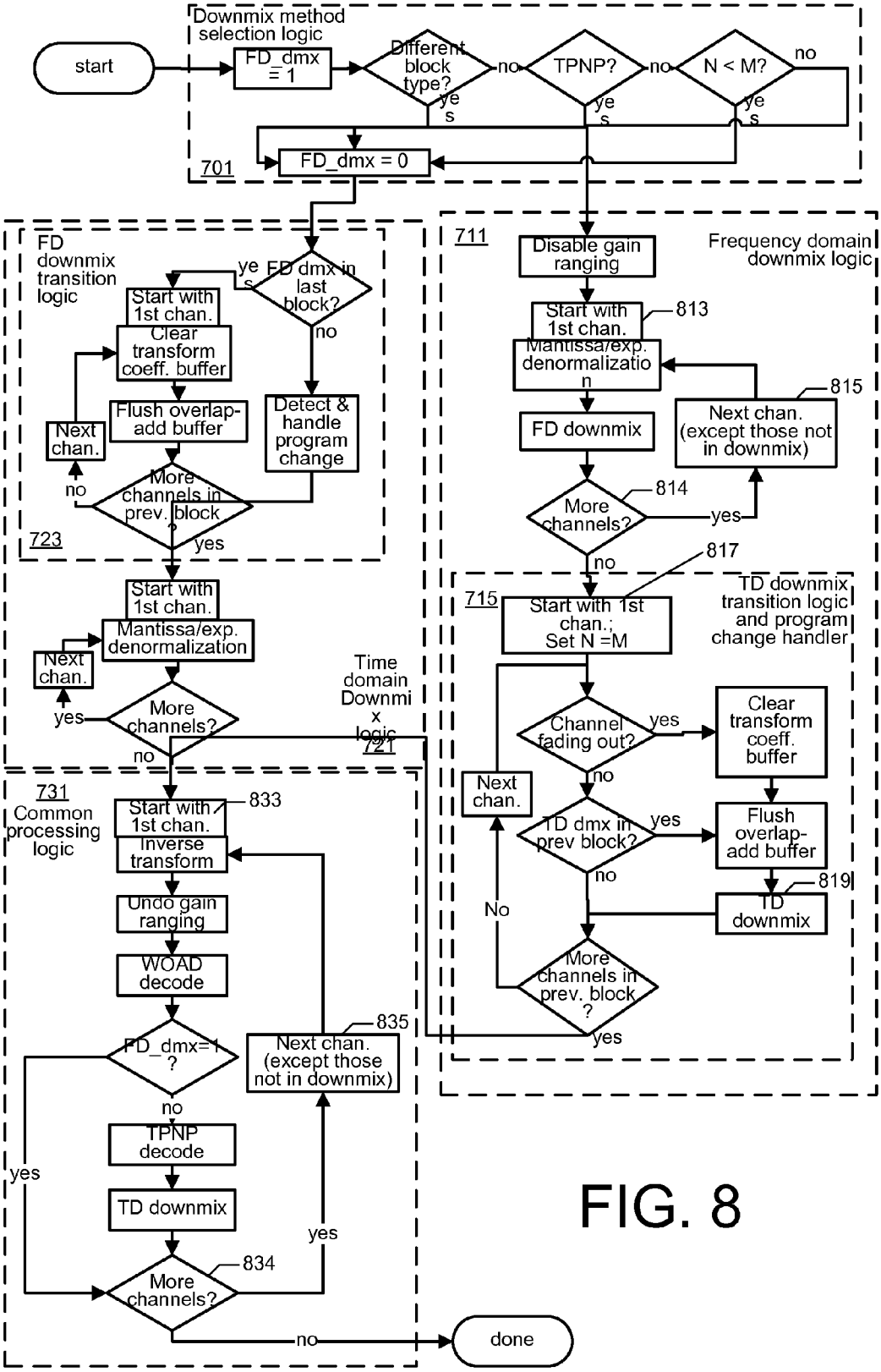
FIG. 8 shows a flowchart of one embodiment of processing for a back-end decode module such as the one shown in FIG. 7.

FIG. 8 shows a flowchart of one embodiment of processing for a back-end decode module such as the one shown in FIG. 7. The flowchart it partitioned as follows, with the same reference numerals used as in FIG. 7 for similar respective functional dataflow blocks: a downmix method selection logic section 701 in which a logical flag FD_dmx is used to indicate when 1 that frequency domain downmixing is used for the block; a TD downmixing logic section 721 that includes a FD downmix transition logic and program change logic section 723 to process differently a block that occurs immediately following a block processed by FD downmixing and carry out program change processing, and a section to denormalize the mantissa by exponents for each input channel. The dataflow after block 721 is processed by a common processing section 731. If the downmix method selection logic block 701 determines the block is for FD downmixing, the dataflow branches to FD downmixing processing section 711 that includes a frequency domain downmix process that disables gain ranging, and for each channel, denormalizes the mantissas by exponents and carries out FD downmixing, and a TD downmix transition logic section 715 to determine for each channel of the previous block whether there is a channel fading out or whether the previous block was processed by TD downmixing, and to process such a block differently. The dataflow after the TD downmix transition section 715 is to the same common processing logic section 731. The common processing logic section 731 includes for each channel inverse transforming and any further time domain processing. The further time domain processing includes undoing gain ranging, and windowing and overlap-add processing. If FD_dmx is 0, indicating TD downmixing, the further time domain processing in 731 also includes any TPNP processing and time domain downmixing.

Note that after the FD downmixing, in the TD downmix transition logic section 715, in 817, the number of input channels N is set to be the same as the number of output channels M, so that the remainder of the processing, e.g., the processing in common processing logic section 731 is carried out only on the downmixed data. This reduces the amount of computation. Of course the time domain downmixing of the data from the previous block when there is a transition from a block that was TD downmixed—such TD downmixing shows as 819 in section 715—is carried out on all of those of the N input channels that are involved in the downmixing.

Transition Handling

In decoding, it is necessary to have smooth transitions between audio blocks. E-AC-3 and many other encoding methods use a lapped transform. e.g., a 50% overlapping MDCT. Thus, when processing a current block, there is 50% overlap with the previous block, and furthermore, there will be 50% overlap with the following block in the time domain. Some embodiments of the present invention use overlap-add logic that includes an overlap-add buffer. When processing a present block, the overlap-add buffer contains data from the previous audio block. Because it is necessary to have smooth transitions between audio blocks, logic is included to handle differently transitions from TD downmixing to FD downmixing, and from FD downmixing to TD downmixing.

Figure 9:
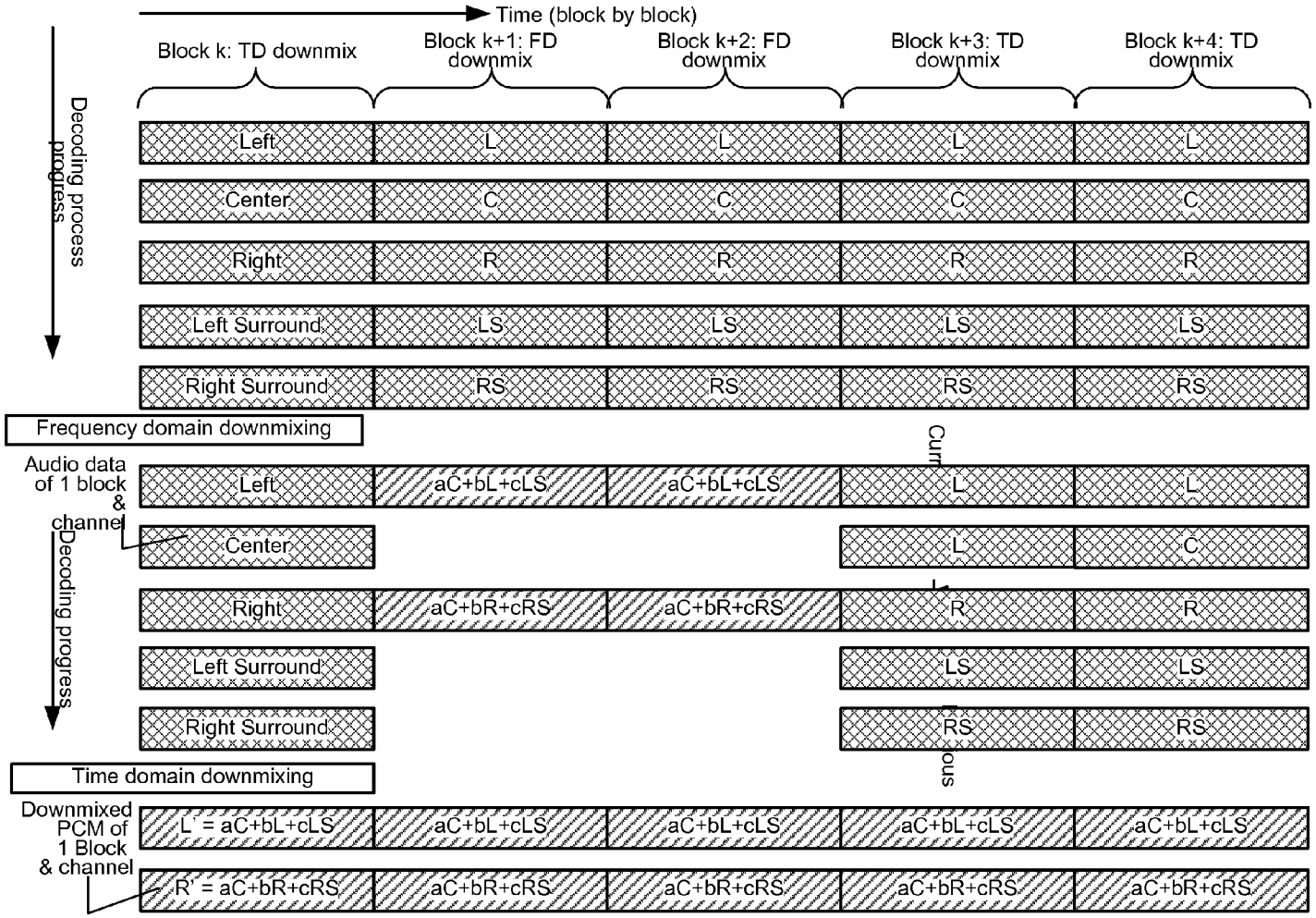
FIG. 9 shows an example of processing five blocks that includes downmixing from 5.1 to 2.0 using an embodiment of the present invention for the case of a non-overlap transform that includes downmixing from 5.1 to 2.0.

FIG. 9 shows an example of processing five blocks, denoted as block k, k+1, . . . , k+4 of five channel audio including as is common: left, center, right, left surround and right surround channels, denoted L, C, R, LS, and RS, respectively, and downmixing to a stereo mix using the formula:

Left output denoted $L'=aC+bL+cLS$, and Right output denoted $R'=aC+bR+cRS$.

FIG. 9 supposes that a non-overlapped transform is used. Each rectangle represents the audio contents of a block. The horizontal axes from left to right represents the blocks k, . . . , k+4 and the vertical axes from top to bottom represents the decoding progress of data. Suppose block k is processed by TD downmixing, blocks k+1 and k+2 processed by FD downmixing, and blocks k+3 and k+4 by TD downmixing. As can be seen, for each of the TD downmixing blocks, the downmixing does not occur until after the time domain downmixing towards the bottom after which the contents are the downmixed L' and R' channels, while for the FD downmixed block, the left and right channels in the frequency domain are already downmixed after frequency domain downmixing, and the C, LS, and RS channel data are ignored. Since there is no overlap between blocks, no special case handling is required when switching from TD downmixing to FD downmixing or from FD downmixing to TD downmixing.

Figure 10:
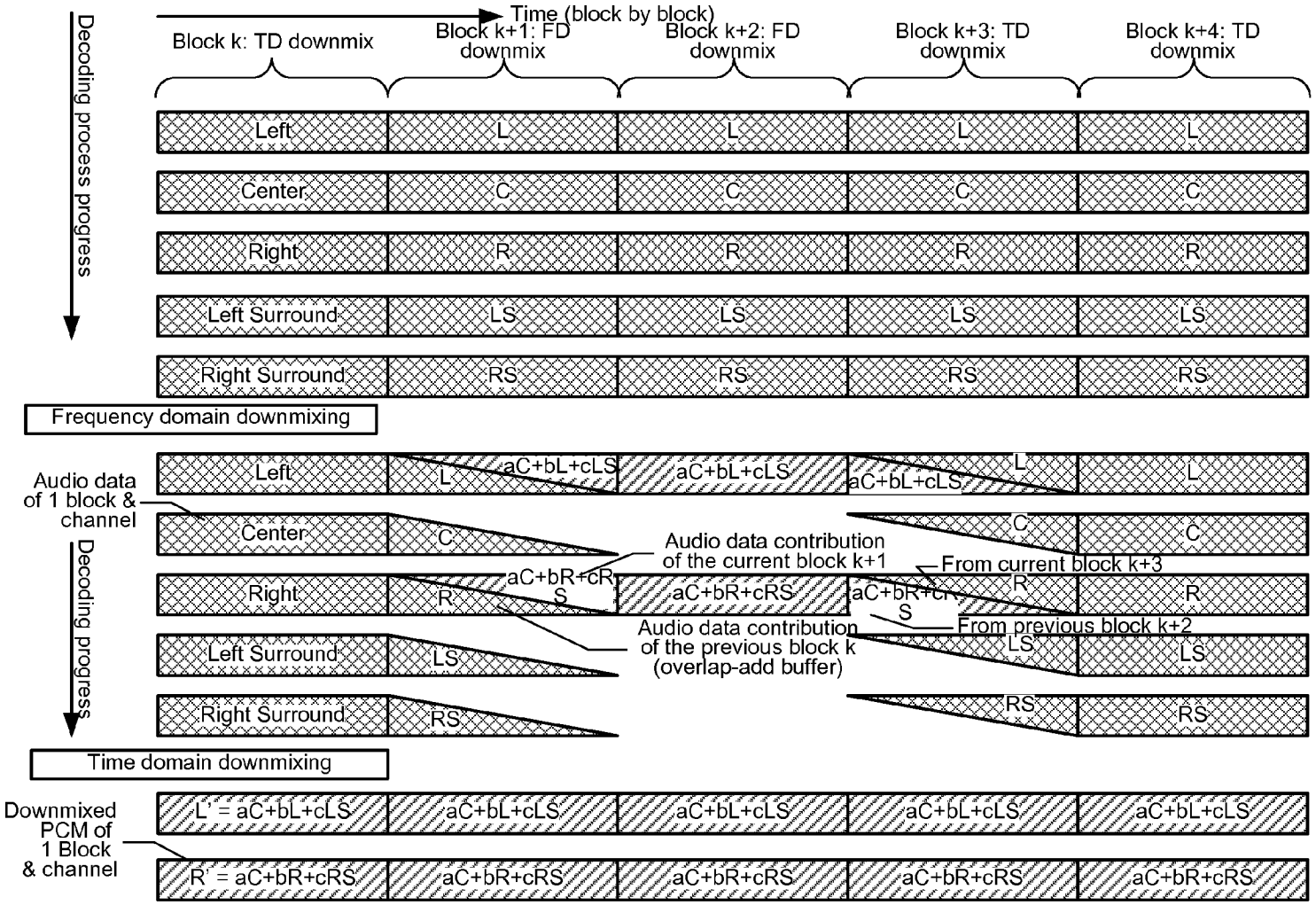
FIG. 10 shows another example of processing five blocks that includes downmixing from 5.1 to 2.0 using an embodiment of the present invention for the case of an overlapping transform.

FIG. 10 describes the case of 50% overlapped transforms. Suppose overlap-add is carried out by overlap-add decoding using an overlap-add buffer. In this diagram, when the data block is shown as two triangles, the lower left triangle is data in the overlap-add buffer from the previous block, while the top right triangle shows the data from the current block.

Transition Handling for a TD Downmix to FD Downmix Transition

Consider block k+1 which is a FD downmixing block that immediately follows a TD downmixing block. After the TD downmixing, the overlap-add buffer contains the L, C, R, LS, and RS data from the last block which needs to be included for the present block. Also included is the current block k+1's contribution, already FD downmixed. In order to properly determine the downmixed PCM data for output, both the present block's and the previous block's data needs to be included. For this, the previous block's data needs to be flushed out and, since it is not yet downmixed, downmixed in the time domain. The two contributions need to be added to determine the downmixed PCM data for output. This processing is included in the TD downmix transition logic 715 of FIGS. 7 and 8, and by the code in the TD downmix transition logic included in the FD downmix module shown in FIG. 5B. The processing carried out therein is summarized in the TD downmix transition logic section 715 of FIG. 8. In more detail, transition handling for a TD downmix to FD downmix transition includes:

- Flush out overlap buffers by feeding zeros into overlap-add logic and carrying out windowing and overlap-add. Copy the flushed out output from the overlap-add logic. This is the PCM data of the previous block of the particular channel prior to downmixing. Overlap buffer now contains zeroes.
- Time domain downmix the PCM data from the overlap buffers to generate PCM data of the TD downmix of the previous block.
- Frequency domain downmix of the new data from the current block. Carry out the inverse transform and feed new data after FD downmixing and inverse transform into overlap-add logic. Carry out windowing and overlap-add, and so forth with the new data to generate PCM data of the FD downmix of the current block.
- Add the PCM data of the TD downmix and of the FD downmix to generate PCM output.

Note that in an alternate embodiment, assuming there was no TPNP in the previous block, the data in the overlap-add buffers are downmixed, then an overlap-add operation is performed on the downmixed output channels. This avoids needing to carry out an overlap-add operation for each previous block channel. Furthermore, as described above for AC-3 decoding, when a downmix buffer and its corresponding 128-sample long half-block delay buffer is used and windowed and combined to produce 256 PCM output samples, the downmix operation is simpler because the delay buffer is only 128 samples rather than 256. This aspect reduces the peak computational complexity that is inherent to the transition processing. Therefore, in some embodiments, for a particular block that is FD downmixed following a block whose data was TD downmixed, the transition processing includes applying downmixing in the pseudo-time domain to the data of the previous block that is to be overlapped with the decoded data of the particular block.

Transition Handling for a FD Downmix to TD Downmix Transition.

Consider block k+3 which is a TD downmixing block that immediately follows a FD downmixing block k+2. Because the previous block was a FD domain downmixing block, the overlap-add buffer at the earlier stages, e.g., prior to TD downmixing contain the downmixed data in the left and right channels, and no data in the other channels. The current block's contributions are not downmixed until after the TD downmixing. In order to properly determine the downmixed PCM data for output, both the present block's and the previous block's data needs to be included. For this, the previous block's data needs to be flushed out. The present block's data needs to be downmixed in the time domain and added to the inverse transformed data that was flushed out to determine the downmixed PCM data for output. This processing is included in the FD downmix transition logic 723 of FIGS. 7 and 8, and by the code in the FD downmix transition logic module shown in FIG. 5B. The processing carried out therein is summarized in the FD downmix transition logic section 723 of FIG. 8. In more detail, assuming there are output PCM buffers for each output channel, transition handling for a FD downmix to TD downmix transition includes:

- Flush the overlap buffers by feeding zeros into overlap-add logic and carrying out windowing and overlap-add. Copy the output into the output PCM buffer. The data flushed out is the PCM data of the FD downmix of the previous block. The overlap buffer now contains zeros.
- Carry out inverse transforming of the new data of the current block to generate pre-downmixing data of the current block. Feed this new time domain data (after transform) into the overlap-add logic.
- Carry out windowing and overlap-add, TPNP if any, and TD downmix with the new data from the current block to generate PCM data of the TD downmix of the current block
- Add the PCM data of the TD downmix and of the FD downmix to generate PCM output.

In addition to transitions from time domain downmixing to frequency domain downmixing, program changes are handled in the time domain downmix transition logic and program change handler. Newly emerging channels are automatically included in the downmix and hence do not need any special treatment. Channels which are no longer present in the new program need to be faded out. This is carried out, as shown in section 715 in FIG. 8 for the FD downmixing case, by flushing out the overlap buffers of the fading channels. Flushing out is carried out by feeding zeros into the overlap-add logic and carrying out windowing and overlap-add.

Note that the flowchart shown and in some embodiments, the Frequency domain downmix logic section 711 includes disabling the optional gain ranging feature for all channels that are part of the frequency domain downmix. Channels may have different gain ranging parameters which would induce different scaling of a channel's spectral coefficients, thus preventing a downmix.

In an alternative implementation, the FD downmixing logic section 711 is modified such that the minimum of all gains is used to perform gain ranging for a (frequency domain) downmixed channel.

Time Domain Downmixing with Changing Downmixing Coefficients and Need for Explicit Cross Fading Downmixing can create several problems. Different downmix equations are called for in different circumstances, thus, the downmix coefficients may need to change dynamically based on signal conditions. Metadata parameters are available that allow tailoring the downmix coefficients for optimal results.

Thus, the downmixing coefficients can change over time. When there is a change from a first set of downmixing coefficients to a second set of downmixing coefficients, the data should be cross-faded from the first set to the second set.

When downmixing is carried out in the frequency domain, and also in many decoder implementations, e.g., in a prior art AC-3 decoder, such as shown in FIG. 1, the downmixing is carried out prior to the windowing and overlap-add operations. The advantage of carrying out downmixing in the frequency domain, or in the time domain prior to windowing and overlap-add is that there is inherent cross-fading as a result of the overlap-add operations. Hence, in many known AC-3 decoders and decoding methods in which the downmixing is carried out in the window domain after inverse transforming, or in the frequency domain in the hybrid downmixing implementations, there is no explicit cross-fade operation.

In the case of time domain downmixing and transient pre-noise processing (TPNP), there would be a one block delay in transient pre-noise processing decoding caused by program change issues, e.g., in a 7.1 decoder. Thus, in embodiments of the present invention, when downmixing is carried out in the time domain and TPNP is used, time domain downmixing is carried out after the windowing and overlap-add. The order of processing in the case time domain downmixing is used, is: carrying out the inverse transform, e.g., MDCT, carrying out windowing and overlap-add, carrying out any transient pre-noise processing decoding (no delay), and then time domain downmixing.

In such a case, the time domain downmixing requires cross-fading of previous and current downmixing data, e.g., downmixing coefficients or downmixing tables to ensure that any change in downmix coefficients are smoothed out.

One option is to so carry out cross-fade operation to compute the resultant coefficient. Denote by c[i] the mixing coefficient to use, where i denotes the time index of 256 time domain samples, so that the range is i=0, . . . , 255. Denote by $w^2[i]$·a positive window function such that $w^2[i]+w^2[255-i]=1$ for i=0, . . . , 255. Denote by $c_{old}$ the pre-update mixing coefficient and by $c_{new}$ the updated mixing coefficient. The cross-fade operation to apply is:

$$c[i]=w^2[i]\cdot c_{new}+w^2[255-i]\cdot c_{old} \text{ for } i=0, \ldots, 255.$$

After each pass through the coefficient cross fade operation, the old coefficients are updated with the new, as $c_{old} \leftarrow c_{new}$.

In the next pass, if the coefficients are not updated, $$c[i]=w^2[i]\cdot c_{new}+w^2[255-i]\cdot c_{new}=c_{new}.$$

In other words, the influence of the old coefficient set is completely gone!

The inventors observed that in many audio streams and downmixing situations, mixing coefficients do not often change. To improve the performance of the time domain downmixing process, embodiments of the time domain downmixing module include testing to ascertain if the downmixing coefficients have changed from their previous value, and if not, to carry out downmixing, else, if they have changed, to carry out cross-fading of the downmixing coefficients according to a pre-selected positive window function. In one embodiment, the window function is the same window function as used in the windowing and overlap-add operations. In another embodiment, a different window function is used.

FIG. 11 shows simplified pseudocode for one embodiment of downmixing. The decoder for such an embodiment uses at least one x86 processor that executes SSE vector instructions. The downmixing includes ascertaining if the new downmixing data are unchanged from the old downmixing data. If so, the downmixing includes setting up for running SSE vector instructions on at least one of the one or more x86 processors, and downmixing using the unchanged downmixing data including executing at least one running SSE vector instruction. Otherwise, if the new downmixing data are changed from the old downmixing data, the method includes determining cross-faded downmixing data by cross-fading operation.

Excluding Processing Unneeded Data

In some downmixing situations, there is at least one channel that does not contribute to the downmixed output. For example, in many cases of downmixing from 5.1 audio to stereo, the LFE channel is not included, so that the downmix is 5.1 to 2.0. The exclusion of the LFE channel from the downmix may be inherent to the coding format, as is the case for AC-3, or controlled by metadata, as is the case for E-AC-3. In E-AC-3, the lfemixlevcode parameter determines whether or not the LFE channel is included in the downmix. When the lfemixlevcode parameter is 0, the LFE channel is not included in the downmix.

Recall that downmixing may be carried out in the frequency domain, in the pseudo-time domain after inverse transforming but before the windowing and overlap add operation, or in the time domain after inverse transforming and after the windowing and overlap add operation. Pure time domain downmixing is carried out in many known E-AC-3 decoders, and in some embodiments of the present invention, and is advantageous, e.g., because of the presence of TPNP, pseudo-time domain downmixing is carried out in many AC-3 decoders and in some embodiments of the present invention, and is advantageous because the overlap-add operation provides inherent cross-fading that is advantageous for when downmixing coefficients change, and frequency domain downmixing is carried out in some embodiments of the present invention when conditions allow.

As discussed herein, frequency-domain downmixing is the most efficient downmixing method, as it minimizes the number of inverse transform and windowing and overlap-add operations required to produce a 2-channel output from a 5.1-channel input. In some embodiments of the present invention, when FD downmixing is carried out, e.g., in FIG. 8, in the FD downmix loop section 711 in the loop that starts with element 813, ends with 814 and increments in 815 to the next channel, those channels not included in the downmix are excluded in the processing.

Downmixing in either the pseudo-time domain after the inverse transform but before the windowing and overlap-add, or in the time domain after the inverse transform and the windowing and overlap-add is less computationally efficient than in the frequency domain. In many present day decoders, such as present-day AC-3 decoders, downmixing is carried out in the pseudo-time domain. The inverse transform operation is carried out independently from downmixing operation, e.g., in separate modules. The inverse transform in such decoders is carried out on all input channels. This is computationally relatively inefficient, because, in the case of the LFE channel not being included, the inverse transform is still carried out for this channel. This unnecessary processing is significant because, even though the LFE channel is limited bandwidth, applying the inverse transform to the LFE channel requires as much computation as applying the inverse transform to any full bandwidth channel. The inventors recognized this inefficiency. Some embodiments of the present invention include identifying one or more non-contributing channels of the N.n input channels, a non-contributing channel being a channel that does not contribute to the M.m output channels of decoded audio. In some embodiments, the identifying uses information, e.g., metadata that defines the downmixing. In the 5.1 to 2.0 downmixing example, the LFE channel is so identified as a non-contributing channel. Some embodiments of the invention include performing a frequency to time transformation on each channel which contributes to the M.m output channels, and not performing any frequency to time transformation on each identified channel which does not contribute to the M.m channel signal. In the 5.1 to 2.0 example in which the LFE channel does not contribute to the downmix, the inverse transform, e.g., an IMCDT is only carried out on the five full-bandwidth channels, so that the inverse transform portion is carried out with roughly 16% reduction of the computational resources required for all 5.1 channels. Since the IMDCT is a significant source of computational complexity in the decoding method, this reduction may be significant.

In many present day decoders, such as present-day E-AC-3 decoders, downmixing is carried out in the time domain. The inverse transform operation and overlap-add operations are carried out prior to any TPNP and prior to downmixing, independent from the downmixing operation, e.g., in separate modules. The inverse transform and the windowing and overlap-add operations in such decoders are carried out on all input channels. This is computationally relatively inefficient, because, in the case of the LFE channel not being included, the inverse transform and windowing/overlap add are still carried out for this channel. This unnecessary processing is significant because, even though the LFE channel is limited bandwidth, applying the inverse transform and overlap-add to the LFE channel requires as much computation as applying the inverse transform and windowing/overlap-add to any full bandwidth channel. In some embodiments of the present invention, downmixing is carried out in the time domain, and in other embodiments, downmixing may be carried out in the time domain depending on the outcome of applying the downmix method selection logic. Some embodiments of the present invention in which TD downmixing is used include identifying one or more non-contributing channels of the N.n input channels. In some embodiments, the identifying uses information, e.g., metadata that defines the downmixing. In the 5.1 to 2.0 downmixing example, the LFE channel is so identified as a non-contributing channel. Some embodiments of the invention include performing an inverse transform, i.e., frequency to time transformation on each channel which contributes to the M.m output channels, and not performing any frequency to time transformation and other time-domain processing on each identified channel which does not contribute to the M.m channel signal. In the 5.1 to 2.0 example in which the LFE channel does not contribute to the downmix, the inverse transform, e.g., an IMCDT, the overlap-add, and the TPNP are only carried out on the five full-bandwidth channels, so that the inverse transform and windowing/overlap-add portions are carried out with roughly 16% reduction of the computational resources required for all 5.1 channels. In the flowchart of FIG. 8, in the common processing logic section 731, one feature of some embodiments includes that the processing in the loop starting with element 833, continuing to 834, and including the increment to next channel element 835 is carried out for all channels except the non-contributing channels. This happens inherently for a block that is FD downmixed.

While in some embodiments, the LFE is a non-contributing channel, i.e., is not included in the downmixed output channels, as is common in AC-3 and E-AC-3, in other embodiments, a channel other than the LFE is also or instead a non-contributing channel and is not included in the downmixed output. Some embodiments of the invention include checking for such conditions to identify which one or more channels, if any, are non-contributing in that such a channel is not included in the downmix, and, in the case of time domain downmixing, not performing processing through inverse transform and window overlap-add operations for any identified non-contributing channel.

For example, in AC-3 and E-AC-3, there are certain conditions in which the surround channels and/or the center channel are not included in the downmixed output channels. These conditions are defined by metadata included in the encoded bitstream taking predefined values. The metadata, for example, may include information that defines the downmixing including mix level parameters.

Some such examples of such mix level parameters are now described for illustration purposes for the case of E-AC-3. In downmixing to stereo in E-AC-3, two types of downmixing are provided: downmix to an LtRt matrix surround encoded stereo pair and downmix to a conventional stereo signal, LoRo. The downmixed stereo signal (LoRo, or LtRt) may be further mixed to mono. A 3-bit LtRt surround mix level code denoted ltrtsurmixlev, and a 3-bit LoRo surround mix level code denoted lorosurmixlev indicate the nominal downmix level of the surround channels with respect to the left and right channels in a LtRt, or LoRo downmix, respectively. A value of binary '111' indicates a downmix level of 0, i.e., −∞dB. 3-bit LtRt and LoRo center mix level codes denoted ltrtcmixlev, lorocmixlev indicate the nominal downmix level of the center channel with respect to the left and right channels in an LtRt and LoRo downmix, respectively. A value of binary '111' indicates a downmix level of 0, i.e., −∞dB.

There are conditions in which the surround channels are not included in the downmixed output channels. In E-AC-3 these conditions are identified by metadata. These conditions include the cases where surmixlev='10' (AC-3 only), ltrtsurmixlev='111', and lorosurmixlev='111'. For these conditions, in some embodiments, a decoder includes using the mix level metadata to identify that such metadata indicates the surround channels are not included in the downmix, and not processing the surround channels through the inverse transform and windowing/overlap-add stages. Additionally, there are conditions in which the center channel is not included in the downmixed output channels, identified by ltrtcmixlev=='111', lorocmixlev=='111'. For these conditions, in some embodiments, a decoder includes using the mix level metadata to identify that such metadata indicates the center channel is not included in the downmix, and not processing the center channel through the inverse transform and windowing/overlap-add stages.

In some embodiments, the identifying of one or more non-contributing channels is content dependent. As one example, the identifying includes identifying whether one or more channels have an insignificant amount of content relative to one or more other channels. A measure of content amount is used. In one embodiment, the measure of content amount is energy, while in another embodiment, the measure of content amount is the absolute level. The identifying includes comparing the difference of the measure of content amount between pairs of channels to a settable threshold. As an example, in one embodiment, identifying one or more non-contributing channels includes ascertaining if the surround channel content amount of a block is less than each front channel content amount by at least a settable threshold in order to ascertain if the surround channel is a non-contributing channel.

Ideally, the threshold is selected to be as low as possible without introducing noticeable artifacts into the downmixed version of the signal in order to maximize identifying channels as non-contributing to reduce the amount of computation required, while minimizing the quality loss. In some embodiments, different thresholds are provided for different decoding applications, with the choice of threshold for a particular decoding application representing an acceptable balance between quality of downmix (higher thresholds) and computational complexity reduction (lower thresholds) for the specific application.

In some embodiments of the present invention, a channel is considered insignificant with respect to another channel if its energy or absolute level is at least 15 dB below that of the other channel. Ideally, a channel is insignificant relative to another channel if its energy or absolute level is at least 25 dB below that of the other channel.

Using a threshold for the difference between two channels denoted A and B that is equivalent to 25 dB is roughly equivalent to saying that the level of the sum of the absolute values of the two channels is within 0.5 dB of the level of the dominant channel. That is, if channel A is at −6 dBFS (dB relative to full scale) and channel B is at −31 dBFS, the sum of the absolute values of channel A and B will be roughly −5.5 dBFS, or about 0.5 dB greater than the level of channel A.

If the audio is of relatively low quality, and for low cost applications, it may be acceptable to sacrifice quality to reduce complexity, the threshold could be lower than 25 dB. In one example, a threshold of 18 dB is used. In such a case, the sum of the two channels may be within about 1 dB of the level of the channel with the higher level. This may be audible in certain cases, but should not be too objectionable. In another embodiment, a threshold of 15 dB is used, in which case the sum of the two channels is within 1.5 dB of the level of the dominant channel.

In some embodiments, several thresholds are used, e.g., 15 dB, 18 dB, and 25 dB.

Note that while identifying non-contributing channels is described herein above for AC-3 and E-AC-3, the identifying non-contributing channel feature of the invention is not limited to such formats. Other formats, for example, also provide information, e.g., metadata regarding the downmixing that is usable for the identifying of one or more non-contributing channels. Both MPEG-2 AAC (ISO/IEC 13818-7) and MPEG-4 Audio (ISO/IEC 14496-3) are capable of transmitting what is referred to by the standard as a "matrix-mixdown coefficient." Some embodiments of the invention for decoding such formats use this coefficient to construct a stereo or mono signal from a 3/2, i.e., Left, Center, Right, Left Surround, Right Surround signal. The matrix-mixdown coefficient determines how the surround channels are mixed with the front channels to construct the stereo or mono output. Four possible values of the matrix-mixdown coefficient are possible according to each of these standards, one of which is 0. A value of 0 results in the surround channels not being included in the downmix. Some MPEG-2 AAC decoder or MPEG-4 Audio decoder embodiments of the invention include generating a stereo or mono downmix from a 3/2 signal using the mixdown coefficients signalled in the bitstream, and further include identifying a non-contributing channel by a matrix-mixdown coefficient of 0, in which case, the inverse transforming and windowing/overlap-add processing is not carried out.

Figure 12:
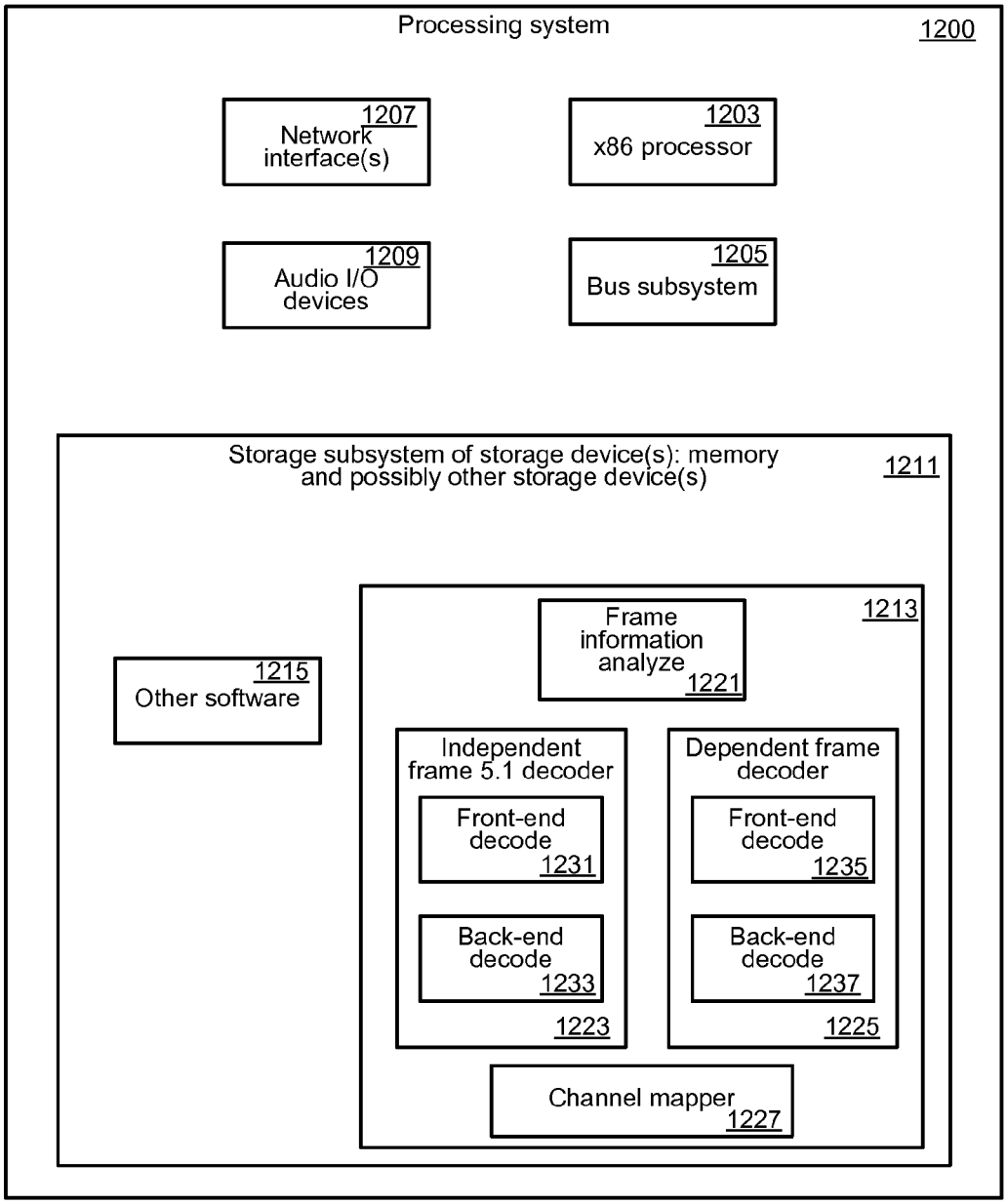
FIG. 12 shows a simplified block diagram of one embodiment of a processing system that includes at least one processor and that can carry out decoding, including one or more features of the present invention.

FIG. 12 shows a simplified block diagram of one embodiment of a processing system 1200 that includes at least one processor 1203. In this example, one x86 processor whose instruction set includes SSE vector instructions is shown. Also shown in simplified block form is a bus subsystem 1205 by which the various components of the processing system are coupled. The processing system includes a storage subsystem 1211 coupled to the processor(s), e.g., via the bus subsystem 1205, the storage subsystem 1211 having one or more storage devices, including at least a memory and in some embodiments, one or more other storage devices, such as magnetic and/or optical storage components. Some embodiments also include at least one network interface 1207, and an audio input/output subsystem 1209 that can accept PCM data and that includes one or more DACs to convert the PCM data to electric waveforms for driving a set of loudspeakers or earphones. Other elements may also be included in the processing system, and would be clear to those of skill in the art, and that are not shown in FIG. 12 for the sake of simplicity.

The storage subsystem 1211 includes instructions 1213 that when executed in the processing system, cause the processing system to carry out decoding of audio data that includes N.n channels of encoded audio data, e.g., E-AC-3 data to form decoded audio data that includes M.m channels of decoded audio, M≥1 and, for the case of downmixing, M<N. For today's known coding formats, n=0 or 1 and m=0 or 1, but the invention is not so limited. In some embodiments, the instructions 1211 are partitioned into modules. Other instructions (other software) 1215 also typically are included in the storage subsystem. The embodiment shown includes the following modules in instructions 1211: two decoder modules: an independent frame 5.1 channel decoder module 1223 that includes a front-end decode module 1231 and a back-end decode module 1233, a dependent frame decoder module 1225 that includes a front-end decode module 1235 and a back-end decode module 1237, a frame information analyze module of instructions 1221 that when executed causes unpacking Bit Stream Information (BSI) field data from each frame to identify the frames and frame types and to provide the identified frames to appropriate front-end decoder module instantiations 1231 or 1235, and a channel mapper module of instructions 1227 that when executed and in the case N>5 cause combining the decoded data from respective back-end decode modules to form the N.n channels of decoded data.

Alternate processing system embodiments may include one or more processors coupled by at least one network link, i.e., be distributed. That is, one or more of the modules may be in other processing systems coupled to a main processing system by a network link. Such alternate embodiments would be clear to one of ordinary skill in the art. Thus, in some embodiments, the system comprises one or more subsystems that are networked via a network link, each subsystem including at least one processor.

Thus, the processing system of FIG. 12 forms an embodiment of an apparatus for processing audio data that includes N.n channels of encoded audio data to form decoded audio data that includes M.m channels of decoded audio, M≥1, in the case of downmixing, M<N, and for upmixing, M>N. While for today's standards, n=0 or 1 and m=0 or 1, other embodiments are possible. The apparatus includes several functional elements expressed functionally as means for carrying out a function. By a functional element is meant an element that carries out a processing function. Each such element may be a hardware element, e.g., special purpose hardware, or a processing system that includes a storage medium that includes instructions that when executed carry out the function. The apparatus of FIG. 12 includes means for accepting the audio data that includes N channels of encoded audio data encoded by an encoding method, e.g., an E-AC-3 coding method, and in more general terms, an encoding method that comprises transforming using an overlapped-transform N channels of digital audio data, forming and packing frequency domain exponent and mantissa data, and forming and packing metadata related to the frequency domain exponent and mantissa data, the metadata optionally including metadata related to transient pre-noise processing.

The apparatus includes means for decoding the accepted audio data.

In some embodiments the means for decoding includes means for unpacking the metadata and means for unpacking and for decoding the frequency domain exponent and mantissa data, means for determining transform coefficients from the unpacked and decoded frequency domain exponent and mantissa data; means for inverse transforming the frequency domain data; means for applying windowing and overlap-add operations to determine sampled audio data; means for applying any required transient pre-noise processing decoding according to the metadata related to transient pre-noise processing; and means for TD downmixing according to downmixing data. The means for TD downmixing, in the case M<N, downmixes according to downmixing data, including in some embodiment, testing whether the downmixing data are changed from previously used downmixing data, and, if changed, applying cross-fading to determine cross-faded downmixing data and downmixing according to the cross-faded downmixing data, and if unchanged directly downmixing according to the downmixing data.

Some embodiments include means for ascertaining for a block whether TD downmixing or FD downmixing is used, and means for FD downmixing that is activated if the means for ascertaining for a block whether TD downmixing or FD downmixing is used ascertains FD downmixing, including means for TD to FD downmix transition processing. Such embodiments also include means for FD to TD downmix transition processing. The operation of these elements is as described herein.

In some embodiments, the apparatus includes means for identifying one or more non-contributing channels of the N.n input channels, a non-contributing channel being a channel that does not contribute to the M.m channels. The apparatus does not carry out inverse transforming the frequency domain data and the applying further processing such as TPNP or overlap-add on the one or more identified non-contributing channels.

In some embodiments, the apparatus includes at least one x86 processor whose instruction set includes streaming single instruction multiple data extensions (SSE) comprising vector instructions. The means for downmixing in operation runs vector instructions on at least one of the one or more x86 processors.

Alternate apparatuses to those shown in FIG. 12 also are possible. For example, one or more of the elements may be implemented by hardware devices, while others may be implemented by operating an x86 processor. Such variations would be straightforward to those skilled in the art.

In some embodiments of the apparatus, the means for decoding includes one or more means for front-end decoding and one or more means for back-end decoding. The means for front-end decoding includes the means for unpacking the metadata and the means for unpacking and for decoding the frequency domain exponent and mantissa data. The means for back-end decoding includes the means for ascertaining for a block whether TD downmixing or FD downmixing is used, the means for FD downmixing that includes the means for TD to FD downmix transition processing, the means for FD to TD downmix transition processing, the means for determining transform coefficients from the unpacked and decoded frequency domain exponent and mantissa data; for inverse transforming the frequency domain data; for applying windowing and overlap-add operations to determine sampled audio data; for applying any required transient pre-noise processing decoding according to the metadata related to transient pre-noise processing; and for time domain downmixing according to downmixing data. The time domain downmixing, in the case M<N, downmixes according to downmixing data, including, in some embodiments, testing whether the downmixing data are changed from previously used downmixing data, and, if changed, applying cross-fading to determine cross-faded downmixing data and downmixing according to the cross-faded downmixing data, and if unchanged, downmixing according to the downmixing data.

For processing E-AC-3 data of more than 5.1 channels of coded data, means for decoding includes multiple instances of the means for front-end decoding and of the means for back-end decoding, including a first means for front-end decoding and a first means for back-end decoding for decoding the independent frame of up to 5.1 channels, a second means for front-end decoding and a second means for back-end decoding for decoding one or more dependent frames of data. The apparatus also includes means for unpacking Bit Stream Information field data to identify the frames and frame types and to provide the identified frames to appropriate means of front-end decoding, and means for combining the decoded data from respective means for back-end decoding to form the N channels of decoded data.

Note that while E-AC-3 and other coding methods use an overlap-add transform, and in the inverse transforming, include windowing and overlap-add operations, it is known that other forms of transforms are possible that operate in a manner such that inverse transforming and further processing can recover time domain samples without aliasing errors. Therefore, the invention is not limited to overlap-add transforms, and whenever is mentioned inverse transforming frequency domain data and carrying out windowed-overlap-add operation to determine time domain samples, those skilled in the art will understand that in general, these operations can be stated as "inverse transforming the frequency domain data and applying further processing to determine sampled audio data."

Although the terms exponent and mantissa are used throughout the description because these are the terms used in AC-3 and E-AC-3, other coding formats may use other terms, e.g., scale factors and spectral coefficients in the case of HE-AAC, and the use of the terms exponent and mantissa does not limit the scope of the invention to formats which use the terms exponent and mantissa.

Unless specifically stated otherwise, as apparent from the following description, it is appreciated that throughout the specification discussions utilizing terms such as "processing," "computing," "calculating," "determining," "generating" or the like, refer to the action and/or processes of a hardware element, e.g., a computer or computing system, a processing system, or similar electronic computing device, that manipulate and/or transform data represented as physical, such as electronic, quantities into other data similarly represented as physical quantities.

In a similar manner, the term "processor" may refer to any device or portion of a device that processes electronic data, e.g., from registers and/or memory to transform that electronic data into other electronic data that, e.g., may be stored in registers and/or memory. A "processing system" or "computer" or a "computing machine" or a "computing platform" may include one or more processors.

Note that when a method is described that includes several elements, e.g., several steps, no ordering of such elements, e.g., steps is implied, unless specifically stated.

In some embodiments, a computer-readable storage medium is configured with, e.g., is encoded with, e.g., stores instructions that when executed by one or more processors of a processing system such as a digital signal processing device or subsystem that includes at least one processor element and a storage subsystem, cause carrying out a method as described herein. Note that in the description above, when it is stated that instructions are configured, when executed, to carry out a process, it should be understood that this means that the instructions, when executed, cause one or more processors to operate such that a hardware apparatus, e.g., the processing system carries out the process.

The methodologies described herein are, in some embodiments, performable by one or more processors that accept logic, instructions encoded on one or more computer-readable media. When executed by one or more of the processors, the instructions cause carrying out at least one of the methods described herein. Any processor capable of executing a set of instructions (sequential or otherwise) that specify actions to be taken is included. Thus, one example is a typical processing system that includes one or more processors. Each processor may include one or more of a CPU or similar element, a graphics processing unit (GPU), and/or a programmable DSP unit. The processing system further includes a storage subsystem with at least one storage medium, which may include memory embedded in a semiconductor device, or a separate memory subsystem including main RAM and/or a static RAM, and/or ROM, and also cache memory. The storage subsystem may further include one or more other storage devices, such as magnetic and/or optical and/or further solid state storage devices. A bus subsystem may be included for communicating between the components. The processing system further may be a distributed processing system with processors coupled by a network, e.g., via network interface devices or wireless network interface devices. If the processing system requires a display, such a display may be included, e.g., a liquid crystal display (LCD), organic light emitting display (OLED), or a cathode ray tube (CRT) display. If manual data entry is required, the processing system also includes an input device such as one or more of an alphanumeric input unit such as a keyboard, a pointing control device such as a mouse, and so forth. The term storage device, storage subsystem, or memory unit as used herein, if clear from the context and unless explicitly stated otherwise, also encompasses a storage system such as a disk drive unit. The processing system in some configurations may include a sound output device, and a network interface device.

The storage subsystem thus includes a computer-readable medium that is configured with, e.g., encoded with instructions, e.g., logic, e.g., software that when executed by one or more processors, causes carrying out one or more of the method steps described herein. The software may reside in the hard disk, or may also reside, completely or at least partially, within the memory such as RAM and/or within the memory internal to the processor during execution thereof by the computer system. Thus, the memory and the processor that includes memory also constitute computer-readable medium on which are encoded instructions.

Furthermore, a computer-readable medium may form a computer program product, or be included in a computer program product.

In alternative embodiments, the one or more processors operate as a standalone device or may be connected, e.g., networked to other processor(s), in a networked deployment, the one or more processors may operate in the capacity of a server or a client machine in server-client network environment, or as a peer machine in a peer-to-peer or distributed network environment. The term processing system encompasses all such possibilities, unless explicitly excluded herein. The one or more processors may form a personal computer (PC), a media playback device, a tablet PC, a set-top box (STB), a Personal Digital Assistant (PDA), a game machine, a cellular telephone, a Web appliance, a network router, switch or bridge, or any machine capable of executing a set of instructions (sequential or otherwise) that specify actions to be taken by that machine.

Note that while some diagram(s) only show(s) a single processor and a single storage subsystem, e.g., a single memory that stores the logic including instructions, those skilled in the art will understand that many of the components described above are included, but not explicitly shown or described in order not to obscure the inventive aspect. For example, while only a single machine is illustrated, the term "machine" shall also be taken to include any collection of machines that individually or jointly execute a set (or multiple sets) of instructions to perform any one or more of the methodologies discussed herein.

Thus, one embodiment of each of the methods described herein is in the form of a computer-readable medium configured with a set of instructions, e.g., a computer program that when executed on one or more processors, e.g., one or more processors that are part of a media device, cause carrying out of method steps. Some embodiments are in the form of the logic itself. Thus, as will be appreciated by those skilled in the art, embodiments of the present invention may be embodied as a method, an apparatus such as a special purpose apparatus, an apparatus such as a data processing system, logic, e.g., embodied in a computer-readable storage medium, or a computer-readable storage medium that is encoded with instructions, e.g., a computer-readable storage medium configured as a computer program product. The computer-readable medium is configured with a set of instructions that when executed by one or more processors cause carrying out method steps. Accordingly, aspects of the present invention may take the form of a method, an entirely hardware embodiment that includes several functional elements, where by a functional element is meant an element that carries out a processing function. Each such element may be a hardware element, e.g., special purpose hardware, or a processing system that includes a storage medium that includes instructions that when executed carry out the function. Aspects of the present invention may take the form of an entirely software embodiment or an embodiment combining software and hardware aspects. Furthermore, the present invention may take the form of program logic, e.g., in a computer readable medium, e.g., a computer program on a computer-readable storage medium, or the computer readable medium configured with computer-readable program code, e.g., a computer program product. Note that in the case of special purpose hardware, defining the function of the hardware is sufficient to enable one skilled in the art to write a functional description that can be processed by programs that automatically then determine hardware description for generating hardware to carry out the function. Thus, the description herein is sufficient for defining such special purpose hardware.

While the computer readable medium is shown in an example embodiment to be a single medium, the term "medium" should be taken to include a single medium or multiple media (e.g., several memories, a centralized or distributed database, and/or associated caches and servers) that store the one or more sets of instructions. A computer readable medium may take many forms, including but not limited to non-volatile media and volatile media. Non-volatile media includes, for example, optical, magnetic disks, and magneto-optical disks. Volatile media includes dynamic memory, such as main memory.

It will also be understood that embodiments of the present invention are not limited to any particular implementation or programming technique and that the invention may be implemented using any appropriate techniques for implementing the functionality described herein. Furthermore, embodiments are not limited to any particular programming language or operating system.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill skilled in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the DESCRIPTION OF EXAMPLE EMBODIMENTS are hereby expressly incorporated into this DESCRIPTION OF EXAMPLE EMBODIMENTS, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

As used herein, unless otherwise specified, the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

It should be appreciated that although the invention has been described in the context of the E-AC-3 standard, the invention is not limited to such contexts and may be utilized for decoding data encoded by other methods that use techniques that have some similarity to E-AC-3. For example, embodiments of the invention are applicable also for decoding coded audio that is backwards compatible with E-AC-3. Other embodiments are applicable for decoding coded audio that is coded according to the HE-AAC standard, and for decoding coded audio that is backwards compatible with HE-AAC. Other coded streams can also be advantageously decoded using embodiments of the present invention.

All U.S. patents, U.S. patent applications, and International (PCT) patent applications designating the United States cited herein are hereby incorporated by reference. In the case the Patent Rules or Statutes do not permit incorporation by reference of material that itself incorporates information by reference, the incorporation by reference of the material herein excludes any information incorporated by reference in such incorporated by reference material, unless such information is explicitly incorporated herein by reference.

Any discussion of prior art in this specification should in no way be considered an admission that such prior art is widely known, is publicly known, or forms part of the general knowledge in the field.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting of only elements A and B. Any one of the terms including or which includes or that includes as used herein is also an open term that also means including at least the elements/features that follow the term, but not excluding others. Thus, including is synonymous with and means comprising.

Similarly, it is to be noticed that the term coupled, when used in the claims, should not be interpreted as being limitative to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional elements. Steps may be added or deleted to methods described within the scope of the present invention.

We claim:

1. A method of operating an audio decoder to decode audio data that includes encoded blocks of N.n channels of audio data to form decoded audio data that includes M.m channels of decoded audio, M>1, n being the number of low frequency effects channels in the encoded audio data, and m being the number of low frequency effects channels in the decoded audio data, the method comprising:

accepting the audio data that includes blocks of N.n channels of encoded audio data encoded by an encoding method, the encoding method including transforming N.n channels of digital audio data, and forming and packing frequency domain exponent and mantissa data; and decoding the accepted audio data, the decoding including:

unpacking and decoding the frequency domain exponent and mantissa data;

determining transform coefficients from the unpacked and decoded frequency domain exponent and mantissa data;

inverse transforming the frequency domain data and applying further processing to determine sampled audio data; and time-domain downmixing at least some blocks of the determined sampled audio data according to downmixing data for the case M<N, wherein the method includes identifying one or more non-contributing channels of the N.n input channels, a non-contributing channel being a channel that does not contribute to the M.m channels, and wherein the method does not carry out inverse transforming the frequency domain data and the applying further processing on the one or more identified non-contributing channels.

2. The method according to claim 1, wherein the decoding includes downmixing in the time domain.

3. The method according to claim 1, wherein the decoding includes determining block by block whether to apply frequency domain downmixing or time domain downmixing, and if it is determined for a particular block to apply frequency domain downmixing, applying frequency domain downmixing for the particular block, otherwise applying time domain downmixing.

4. The method according to claim 3, wherein the determining whether to apply frequency domain downmixing or time domain downmixing includes determining if there is any transient pre-noise processing, and determining if any of the N channels have a different block type such that frequency domain downmixing is applied only for a block that has the same block type in the N channels, no transient pre-noise processing, and M<N.

5. The method according to claim 3, wherein the transforming in the encoding method uses an overlapped-transform and the further processing includes applying windowing and overlap-add operations to determine sampled audio data, wherein applying frequency domain downmixing for the particular block includes determining if downmixing for the previous block was by time domain downmixing and if the downmixing for the previous block was by time domain downmixing, applying downmixing in the time domain or a pseudo-time domain to the data of the previous block that is to be overlapped with the decoded data of the particular block, and wherein applying time domain downmixing for a particular block includes determining if downmixing for the previous block was by frequency domain downmixing, and if the downmixing for the previous block was by frequency domain downmixing, processing the particular block differently than if the downmixing for the previous block was not by frequency domain downmixing.

6. The method according to claim 1, wherein the decoding includes downmixing in the time domain, wherein the decoder uses at least one x86 processor whose instruction set includes streaming single instruction multiple data extensions (SSE) comprising vector instructions, and wherein the time domain downmixing includes running vector instructions on at least one of the one or more x86 processors.

7. The method according to claim 1, wherein n=1 and m=0, such that inverse transforming and applying further processing are not carried out on the low frequency effect channel.

8. The method according to claim 1, wherein the audio data that includes encoded blocks includes information that defines the downmixing, and wherein the identifying one or more non-contributing channels uses the information that defines the downmixing.

9. The method according to claim 8, wherein the information that defines the downmixing includes mix level parameters that have predefined values that indicate that one or more channels are non-contributing channels.

10. The method according to claim 1, wherein the accepted audio data are in the form of a bitstream of frames of coded data, and wherein the decoding is partitioned into a set of front-end decode operations, and a set of back-end decode operations, the front-end decode operations including the unpacking and decoding the frequency domain exponent and mantissa data of a frame of the bitstream into unpacked and decoded frequency domain exponent and mantissa data for the frame, and the frame's accompanying metadata, the back-end decode operations including the determining of the transform coefficients, the inverse transforming and applying further processing, applying any required transient pre-noise processing decoding, and downmixing in the case M<N.

11. The method according to claim 1, wherein the encoded audio data are encoded according to one of the set of standards consisting of the AC-3 standard, the E-AC-3 standard, a standard backwards compatible with the E-AC-3 standard, the HE-AAC standard, and a standard backwards compatible with the HE-AAC standard.

12. A tangible computer-readable storage medium storing decoding instructions that when executed by one or more processors of a processing system cause carrying out a method of decoding audio data that includes encoded blocks of N.n channels of audio data to form decoded audio data that includes M.m channels of decoded audio, M>1, n being the number of low frequency effects channels in the encoded audio data, and m being the number of low frequency effects channels in the decoded audio data, the method comprising:

accepting the audio data that includes blocks of N.n channels of encoded audio data encoded by an encoding method, the encoding method including transforming N.n channels of digital audio data, and forming and packing frequency domain exponent and mantissa data; and decoding the accepted audio data, the decoding including:

unpacking and decoding the frequency domain exponent and mantissa data;

determining transform coefficients from the unpacked and decoded frequency domain exponent and mantissa data;

inverse transforming the frequency domain data and applying further processing to determine sampled audio data; and time-domain downmixing at least some blocks of the determined sampled audio data according to downmixing data for the case M<N, wherein the method includes identifying one or more non-contributing channels of the N.n input channels, a non-contributing channel being a channel that does not contribute to the M.m channels, and wherein the method does not carry out inverse transforming the frequency domain data and the applying further processing on the one or more identified non-contributing channels.

13. The tangible computer-readable storage medium according to claim 12, wherein the decoding includes downmixing in the time domain.

14. The tangible computer-readable storage medium according to claim 12, wherein the decoding includes determining block by block whether to apply frequency domain downmixing or time domain downmixing, and if it is determined for a particular block to apply frequency domain downmixing, applying frequency domain downmixing for the particular block, otherwise applying time domain downmixing.

15. The tangible computer-readable storage medium according to claim 14, wherein the determining whether to apply frequency domain downmixing or time domain downmixing includes determining if there is any transient pre-noise processing, and determining if any of the N channels have a different block type such that frequency domain downmixing is applied only for a block that has the same block type in the N channels, no transient pre-noise processing, and M<N.

16. The tangible computer-readable storage medium according to claim 14, wherein the transforming in the encoding method uses an overlapped-transform and the further processing includes applying windowing and overlap-add operations to determine sampled audio data, wherein applying frequency domain downmixing for the particular block includes determining if downmixing for the previous block was by time domain downmixing and if the downmixing for the previous block was by time domain downmixing, applying downmixing in the time domain or a pseudo-time domain to the data of the previous block that is to be overlapped with the decoded data of the particular block, and wherein applying time domain downmixing for a particular block includes determining if downmixing for the previous block was by frequency domain downmixing, and if the downmixing for the previous block was by frequency domain downmixing, processing the particular block differently than if the downmixing for the previous block was not by frequency domain downmixing.

17. The tangible computer-readable storage medium according to claim 12, wherein the decoding includes downmixing in the time domain, wherein the decoder uses at least one x86 processor whose instruction set includes streaming single instruction multiple data extensions (SSE) comprising vector instructions, and wherein the time domain downmixing includes running vector instructions on at least one of the one or more x86 processors.

18. The tangible computer-readable storage medium according to claim 12, wherein n=1 and m=0, such that inverse transforming and applying further processing are not carried out on the low frequency effect channel.

19. The tangible computer-readable storage medium according to claim 12, wherein the audio data that includes encoded blocks includes information that defines the downmixing, and wherein the identifying one or more non-contributing channels uses the information that defines the downmixing.

20. The tangible computer-readable storage medium according to claim 19, wherein the information that defines the downmixing includes mix level parameters that have predefined values that indicate that one or more channels are non-contributing channels.

21. The tangible computer-readable storage medium according to claim 12, wherein the accepted audio data are in the form of a bitstream of frames of coded data, and wherein the decoding is partitioned into a set of front-end decode operations, and a set of back-end decode operations, the front-end decode operations including the unpacking and decoding the frequency domain exponent and mantissa data of a frame of the bitstream into unpacked and decoded frequency domain exponent and mantissa data for the frame, and the frame's accompanying metadata, the back-end decode operations including the determining of the transform coefficients, the inverse transforming and applying further processing, applying any required transient pre-noise processing decoding, and downmixing in the case M<N.

22. The tangible computer-readable storage medium according to claim 21, wherein the encoded audio data are encoded according to the E-AC-3 standard or according to a standard backwards compatible with the E-AC-3 standard, and may include more than 5 coded channels, wherein the further processing includes applying windowing and overlap-add operations to determine sampled audio data, wherein, in the case N>5, the coded bitstream includes an independent frame of up to 5.1 coded channels and at least one dependent frame of coded data, wherein the decoding instructions are arranged as a plurality of 5.1 channel decode modules, each 5.1 channel decode module including a respective instantiation of a front-end decode module and a respective instantiation of a back-end decode module, the plurality of 5.1 channel decode modules including a first 5.1 channel decode module that when executed causes decoding of the independent frame, and one or more other channel decode modules for each respective dependent frame, and wherein the decoding instructions further comprise:

a frame information analyze module of instructions that when executed cause unpacking Bit Stream Information field data and to identify the frames and frame types and to provide the identified frames to appropriate front-end decoder module instantiation, and a channel mapper module of instructions that when executed and in the case N>5cause combining the decoded data from respective back-end decode modules to form the N channels of decoded data.

23. The tangible computer-readable storage medium according to claim 12, wherein the encoded audio data are encoded according to one of the set of standards consisting of the AC-3 standard, the E-AC-3 standard, a standard backwards compatible with the E-AC-3 standard, the HE-AAC standard, and a standard backwards compatible with the HE-AAC standard.

24. An apparatus comprising:

a processing system that includes one or more processors and a tangible computer-readable storage medium, wherein the tangible computer-readable storage medium stores decoding instructions that when executed by at least one of the processors cause carrying out a method of decoding audio data that includes encoded blocks of N.n channels of audio data to form decoded audio data that includes M.m channels of decoded audio, M>1, n being the number of low frequency effects channels in the encoded audio data, and m being the number of low frequency effects channels in the decoded audio data, the method comprising:

accepting the audio data that includes blocks of N.n channels of encoded audio data encoded by an encoding method, the encoding method including transforming N.n channels of digital audio data, and forming and packing frequency domain exponent and mantissa data; and decoding the accepted audio data, the decoding including:

unpacking and decoding the frequency domain exponent and mantissa data;

determining transform coefficients from the unpacked and decoded frequency domain exponent and mantissa data;

inverse transforming the frequency domain data and applying further processing to determine sampled audio data; and time-domain downmixing at least some blocks of the determined sampled audio data according to downmixing data for the case M<N, wherein the method includes identifying one or more non-contributing channels of the N.n input channels, a non-contributing channel being a channel that does not contribute to the M.m channels, and wherein the method does not carry out inverse transforming the frequency domain data and the applying further processing on the one or more identified non-contributing channels.

* * * * *